US007880757B2

(12) United States Patent
Nakano et al.

(10) Patent No.: US 7,880,757 B2
(45) Date of Patent: Feb. 1, 2011

(54) IMAGE FORMING DEVICE

(75) Inventors: Takashi Nakano, Kyoto (JP); Hideatsu Shimamoto, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 923 days.

(21) Appl. No.: 11/752,568

(22) Filed: May 23, 2007

(65) Prior Publication Data

US 2008/0012803 A1 Jan. 17, 2008

(30) Foreign Application Priority Data

Jul. 14, 2006 (JP) ..... 2006-194607

(51) Int. Cl.
*B41J 2/45* (2006.01)
*B41J 2/435* (2006.01)
*B41J 27/00* (2006.01)

(52) U.S. Cl. ..... 347/238; 347/263; 347/257

(58) Field of Classification Search ..... 347/238, 347/138, 263, 257
See application file for complete search history.

(56) References Cited

U.S. PATENT DOCUMENTS 6,252,619 B1 * 6/2001 Ueda et al. ..... 347/138
2003/0090556 A1 * 5/2003 Hagstrom et al. ..... 347/104
2004/0228652 A1 11/2004 Fujiwara

FOREIGN PATENT DOCUMENTS

JP 63-018367 A 1/1988
JP 2006-056065 A 3/2006
JP 2006056065 A * 3/2006

OTHER PUBLICATIONS

Official communication issued in counterpart European Application No. 07109365.2, mailed Oct. 17, 2007.

* cited by examiner

*Primary Examiner*—Stephen D Meier
*Assistant Examiner*—Sarah Al-Hashimi
(74) *Attorney, Agent, or Firm*—Keating & Bennett, LLP

(57) ABSTRACT

In an image forming device, a Light Emitting Diode (LED) head is attached to a slide member. The slide member includes a slidable base side member and a leading end side member which can move with respect to the base side member in a direction that is different from a sliding direction of the base side member. The LED head is provided on the leading end side member, and a positioning pin is provided on the LED head. The LED head is positioned with respect to a photo-conductive drum by the positioning pin.

16 Claims, 18 Drawing Sheets

IMAGE FORMING DEVICE

BACKGROUND OF THE INVENTION

1. Field of the Invention

The present invention relates to a configuration of an image forming device such as a printer, a facsimile machine, and a copier constructed to form an image including characters and graphics, etc. onto a paper as a recording medium.

2. Description of the Related Art

A conventional image forming device includes a photoconductive drum, a process unit that can be removably inserted into a device main body, a Light Emitting Diode (LED) head that exposes the photoconductive drum, an LED head supporting unit, and a rack gear. The conventional image forming device further includes a supporting member, a pinion gear that engages with the rack gear, and an operation member having an operating portion for rotating the pinion gear. The supporting member can move in parallel between an adjacent position at which the LED head is positioned adjacent to the photoconductive drum and a distant position at which the LED head is positioned apart from the photoconductive drum.

In the above-described configuration, a parallel movement direction of the supporting member can be different from an exposing direction of the LED head. Moreover, the LED head is provided with a pin and can be positioned at a prescribed position with respect to the photoconductive drum by inserting the pin into a locking portion.

However, in the above-described configuration, a large sloped portion is arranged around the locking portion into which the pin is inserted. The pin is guided by making contact with the sloped portion, and then inserted into the locking portion. Accordingly, since a contact area (a fitting portion) between the locking portion and the pin is small, a positioning function is not sufficient, causing oscillation of the LED head, etc. Therefore, the conventional image forming device leaves room for improvement in view of improving image quality by achieving high accuracy of a desired position and exposing angle of the LED head.

SUMMARY OF THE INVENTION

In order to overcome the above-described problems, preferred embodiments of the present invention provide a configuration for solving such problems. The configuration and its advantages will be described below.

According to a preferred embodiment of the present invention, an image forming device includes the following configuration. The image forming device includes an LED head, a slide member, and a positioning body. The LED head forms an electrostatic latent image by irradiating light onto a photoconductive drum. The LED head is attached to the slide member. The slide member can move between an adjacent position at which the LED head is positioned adjacent to the photoconductive drum and a distant position at which the LED head is positioned apart from the photoconductive drum. The positioning body positions the LED head with respect to the photoconductive drum and has an axis which is not parallel to a moving direction of the slide member. The slide member has a base side member and a leading end side member. The base side member can slide in a first direction. The leading end side member can move with respect to the base side member in a second direction which is different from the first direction. The LED head is provided on the leading end side member. The positioning body is provided on the LED head or on the leading end side member.

According to the above-described configuration, the LED head can be positioned by fitting the positioning body in a direction different from the moving direction of the slide member without forming a large conical or sloped guide surface on the positioning body or its counterpart member. Accordingly, a positioning function at a fitting portion can be sufficiently secured, and oscillation of the LED head, etc. can be prevented.

According to another preferred embodiment of the present invention, the image forming device is preferably configured as described below. That is, in the image forming device, an axial direction of the positioning body is parallel or substantially parallel to a light irradiating direction of the LED head. The second direction is perpendicular or substantially perpendicular to the axial direction of the positioning body.

Accordingly, the above-described configuration is particularly preferable when the moving direction of the slide member is different from the light irradiating direction of the LED head.

According to another preferred embodiment of the present invention, in the image forming device, it is preferable that the positioning body is a positioning pin that can be inserted into a positioning hole provided on a photoconductive drum side.

Accordingly, in the above-described simple configuration, the LED head can be reliably positioned with respect to the photoconductive drum.

According to another preferred embodiment of the present invention, in the image forming device, it is preferable that a positioning portion of the positioning body has a uniform portion in its axial cross section.

According to the above-described configuration, the LED head can be reliably and accurately positioned with respect to the photoconductive drum by the uniform portion in the axial cross section.

According to another preferred embodiment of the present invention, in the image forming device, it is preferable that the uniform portion in the axial cross section has a cylindrical or substantially cylindrical shape.

According to the above-described configuration, a shape of the positioning body can be simplified, and the manufacturing cost can be reduced.

According to another preferred embodiment of the present invention, in the image forming device, it is preferable that a rolling body is provided between the leading end side member and the base side member.

According to the above-described configuration, the leading end side member can stably and smoothly move with respect to the base side member.

According to another preferred embodiment of the present invention, the image forming device is preferably configured as described below. That is, the rolling body is preferably a cylindrical rotating roller. The cylindrical rotating roller rolls on a guide plane formed on the base side member or on the leading end side member. The guide plane is parallel or substantially parallel to the second direction.

Accordingly, with the above-described simple configuration, the leading end side member can move with respect to the base side member in the second direction.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
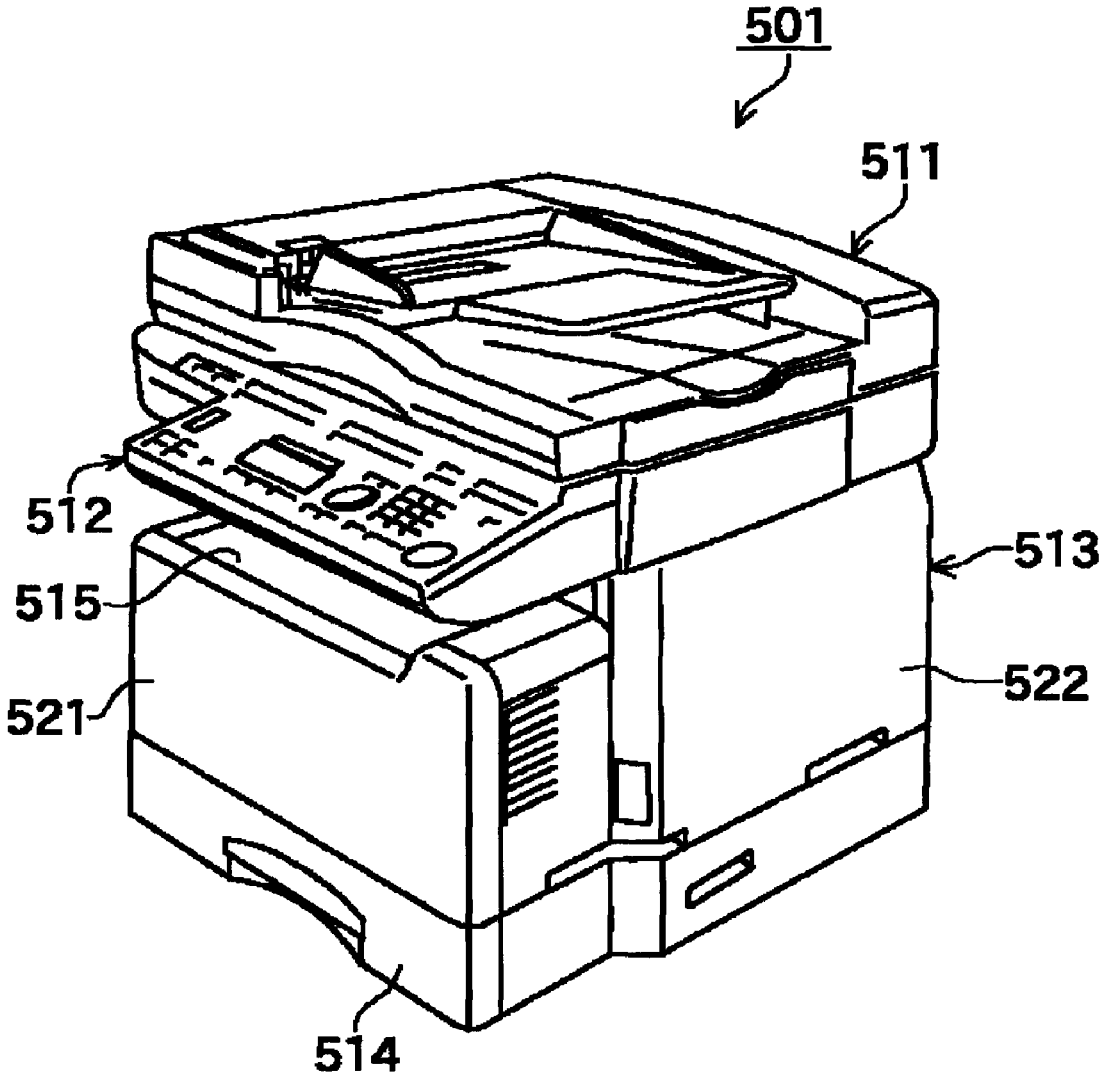
FIG. 1 is an external perspective view of a copy-and-facsimile Multi Function Peripheral (MFP) according to a preferred embodiment of the present invention.

As illustrated in an external perspective view of FIG. 1, a copy-and-facsimile MFP 501 as an example of an image forming device includes an image scanning unit 511, an operation panel 512, a main body 513, and a paper feed cassette 514. The image scanning unit 511 functions as a flatbed scanner and an auto document feed scanner. The operation panel 512 is used for instructing a number of copies and a facsimile destination, etc. The main body 513 has an image forming unit, etc. which forms an image onto a paper as a recording medium. The paper feed cassette 514 sequentially supplies the paper.

The copy-and-facsimile MFP 501 includes a front cover 521 arranged on a front side (a side on which the operation panel 512 is provided) of the main body 513, and includes a jam access cover 522 arranged on one side surface of the main body 513. The front cover 521 and the jam access cover 522 can be opened and closed. For example, when performing maintenance, etc., an inside of the main body 513 can be accessed by opening the front cover 521 and the jam access cover 522.

Figure 2:
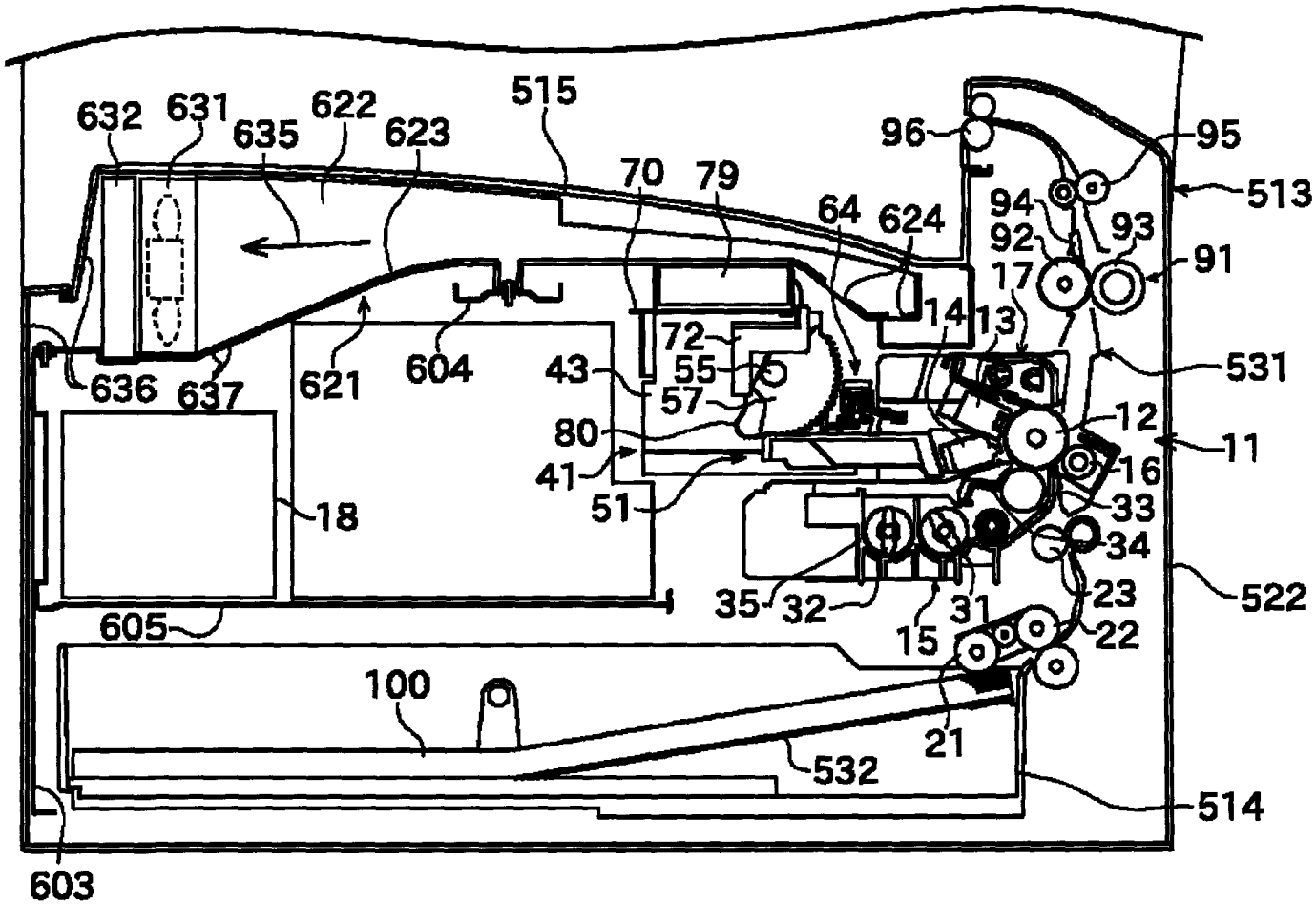
FIG. 2 is a front sectional view illustrating an inside of a main body of the MFP.

FIG. 2 illustrates an inside of the main body 513 of the copy-and-facsimile MFP 501. As illustrated in FIG. 2, the paper feed cassette 514 for supplying paper 100 is arranged at a lower portion of the main body 513. The paper feed cassette 514 can be drawn out to a front side of the device (i.e., a front side of the paper in FIG. 2). An image forming unit 11 is arranged above the paper feed cassette 514. A fixing portion 91 and a paper discharge tray 515 are arranged further above.

In the inside of the main body 513, a transportation path 531 is provided to transport the paper 100 from the paper feed cassette 514 to the paper discharge tray 515. The transportation path 531 extends upward from one end side of the paper feed cassette 514 to the image forming unit 11. Then, after extending further upward and passing through the fixing portion 91, the transportation path 531 curves in a horizontal direction to the paper discharge tray 515. Although not illustrated in FIG. 2, the image scanning unit 511 and the operation panel 512 are arranged above the paper discharge tray 515.

The paper feed cassette 514 is open on its upper side, and is provided with a flapper 532 on its bottom portion such that the flapper 532 can pivot upward and downward. A plurality of papers 100 are stacked on the flapper 532. A paper feed roller 21 is arranged above the flapper 532. When the flapper 532 is pushed up by a biasing spring (not illustrated) and the paper feed roller 21 is driven, an uppermost paper 100 is separated, picked up, and transported towards the transportation path 531.

A separation roller 22 is arranged on an immediately downstream side of the paper feed roller 21 in the transportation path 531. The separation roller 22 and a roller arranged opposite the separation roller 22 are driven, nip the paper 100 therebetween, and then separate the papers 100 one sheet at a time. A resist roller 23 is arranged on a downstream side of the separation roller 22. The resist roller 23 and a roller arranged opposite the resist roller 23 are driven, nip the paper 100 therebetween, and then transport the paper 100 to the image forming unit 11 on a downstream side, adjusting any oblique movement of the paper 100.

Figure 3:
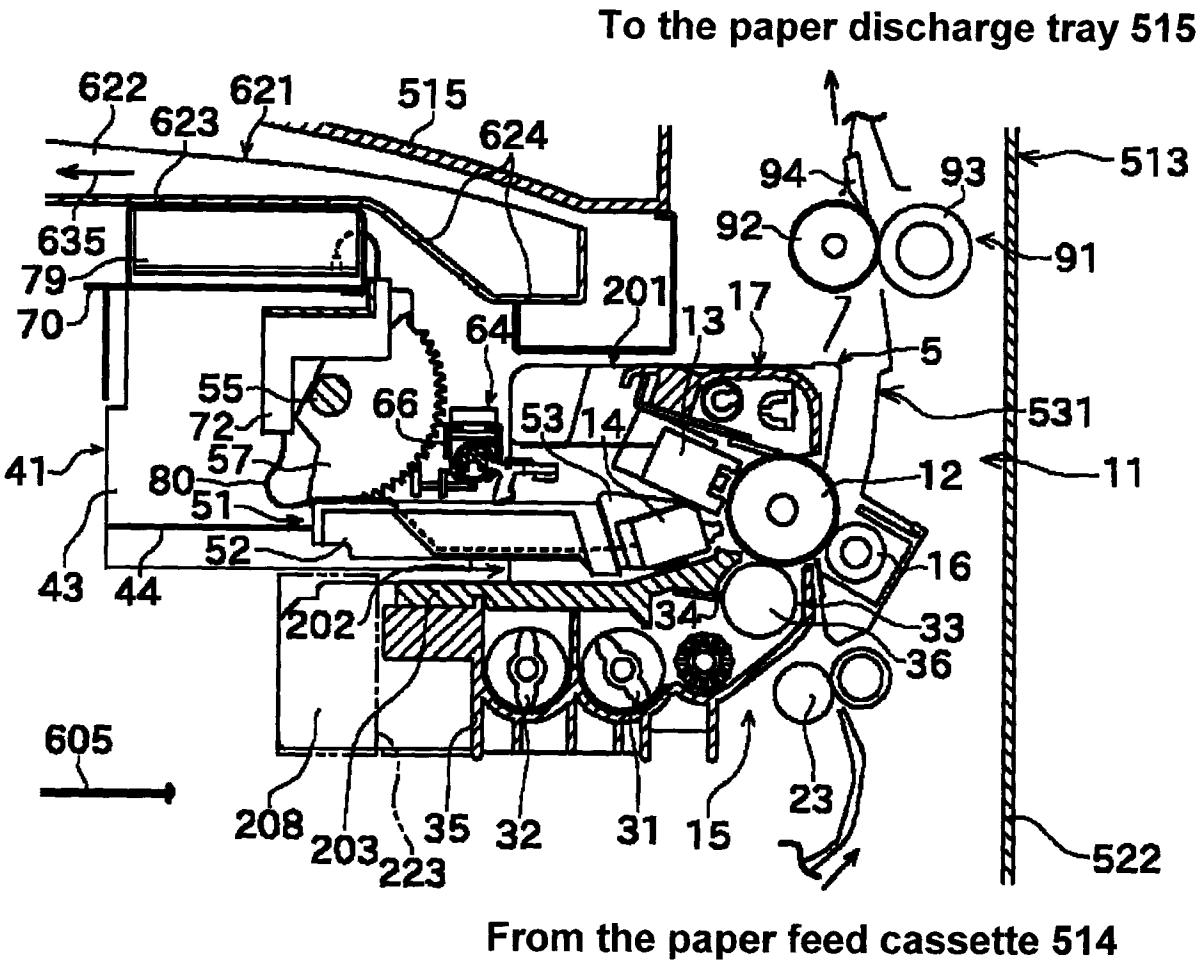
FIG. 3 is an enlarged front sectional view illustrating an image forming unit in detail.

As illustrated in FIGS. 2 and 3, which is an enlarged view of a relevant portion of FIG. 2, the image forming unit 11 is provided with a photoconductive drum 12, a charger 13, an LED head 14, a developing unit 15, a transfer roller 16, and a cleaner 17. The charger 13, the LED head 14, the developing unit 15, the transfer roller 16, and the cleaner 17 are arranged around the photoconductive drum 12.

A photoconductive layer formed of an organic photoreceptor is formed on a surface of the photoconductive drum 12. The photoconductive drum 12 is rotationally driven by a driving motor (not illustrated). The charger 13 may be a scorotron charger, which uses a non-contact corona charging method. The surface of the photoconductive drum 12 is uniformly, and negatively, for example, charged by the charger 13.

The LED head 14 as an exposing unit is arranged on a downstream side (i.e., a downstream side in a rotating direction of the photoconductive drum 12) of the charger 13, and is provided with a plurality of light emitting diodes (LED) collaterally arranged in a paper width direction. Hereinafter, like description will be applied to descriptions of the developing unit 15, the transfer roller 16, and the cleaner 17. A lens array in which a plurality of gradient index lens are collaterally arranged is provided on a surface of the LED head 14. The LED head 14 selectively emits light according to image data of a facsimile original document received via a telephone line or to image data scanned at the image scanning unit 511. As a result, the surface of the photoconductive drum 12 is selectively exposed, and an electrostatic latent image is formed when the charge energy on an exposed portion disappears.

The developing unit 15 is arranged on a downstream side of the LED head 14. The developing unit 15 uses a two-component developing system using toner and carrier as the developer. Specifically, the developing unit 15 includes a synthetic resin-made developer container 35 (hereinafter, the term "resin" includes resin or plastic), two screw-shaped agitating members 31, 32 arranged inside the developer container 35, and a small space arranged with respect to the photoconductive drum 12 such that the developer container 35, the agitating members 31, 32, and the space are adjacently arranged. Moreover, the developing unit 15 further includes a developer carrier 33 supported by the developer container 35, and a control blade 34 arranged adjacent to a surface of the developer carrier 33.

The agitating members 31 and 32 are rotationally driven, and circulate the two-component developer inside the developer container 35 while uniformly mixing the toner and the carrier by rotation. The developer carrier 33 preferably has a substantially cylindrical shape and is made of a nonmagnetic material. The developer carrier 33 rotationally fits around an outer side of a cylindrically-shaped magnetic body 36. The magnetic body 36 inside the developer carrier 33 magnetically absorbs the two-component developer onto a surface of the developer carrier 33. By rotating the developer carrier 33 under the above-described state, the two-component developer is transported to a side of the photoconductive drum 12 while being maintained on the surface of the developer carrier 33. A thickness of the two-component developer on the surface of the developer carrier 33 is controlled by the control blade 34 to be even.

Then, at a portion where the photoconductive drum 12 and the developer carrier 33 come close to each other, the toner of the two-component developer on the surface of the developer carrier 33 is selectively transferred onto the surface of the photoconductive drum 12 only to a portion exposed by the LED head 14. As a result, a toner image according to the electrostatic latent image is formed on the surface of the photoconductive drum 12. The carrier of the two-component developer and the remaining toner which has not been transferred to the side of the photoconductive drum 12 are collected in the developer container 35.

The transfer roller 16 is arranged on a downstream side of the developing unit 15 and on an opposite side of the photoconductive drum 12 across the transportation path 531. A prescribed voltage from a voltage source is applied to the transfer roller 16. Accordingly, the toner image formed on the surface of the photoconductive drum 12 is moved towards a side of the transfer roller 16 by rotation of the photoconductive drum 12 and transferred onto the paper 100 by an electric field attraction force of the transfer roller 16.

The cleaner 17 is arranged on a downstream side of the transfer roller 16. The cleaner 17 removes the electrical charge from the remaining toner which has not been transferred onto the paper 100 at the transfer roller 16, scrapes the remaining toner off of the surface of the photoconductive drum 12, and accumulates the scraped toner.

In the above-described image forming unit 11, at least the photoconductive drum 12, the charger 13, the developing unit 15, and the cleaner 17 are contained in a synthetic resin-made cartridge, and define a process cartridge 5 (a process unit). The paper 100 on which the toner image has been transferred at the image forming unit 11 is transported by the rotation of the photoconductive drum 12 to the fixing portion 91 arranged at a downstream side of the transportation path 531.

As illustrated in FIGS. 2 and 3, the fixing portion 91 includes a heating source (such as a halogen lamp), a rotationally driven heat roller 92, and a pressing roller 93 arranged opposite the heat roller 92. The pressing roller 93 is pressed against the heat roller 92 by a biasing spring (not illustrated). In the above-described configuration, when the paper 100 passes between the heat roller 92 and the pressing roller 93, the toner in the toner image is melted and fixed to the paper 100 by the high heat of the heat roller 92 and pressure of the pressing roller 93. The fixing portion 91 is provided with a separating claw 94 for preventing the paper 100 from sticking to and winding around the heat roller 92.

As illustrated in FIG. 2, a transportation roller 95 is arranged on a downstream side of the fixing portion 91, and a discharge roller 96 is arranged on a further downstream side. In the above-described configuration, the paper 100 transported from the fixing portion 91 is nipped between the transportation roller 95 and a driven roller arranged opposite the transportation roller 95, and transported to a downstream side. Furthermore, the paper 100 is nipped between the discharge roller 96 and a driven roller arranged opposite the discharge roller 96, and discharged onto the paper discharge tray 515.

Figure 4:
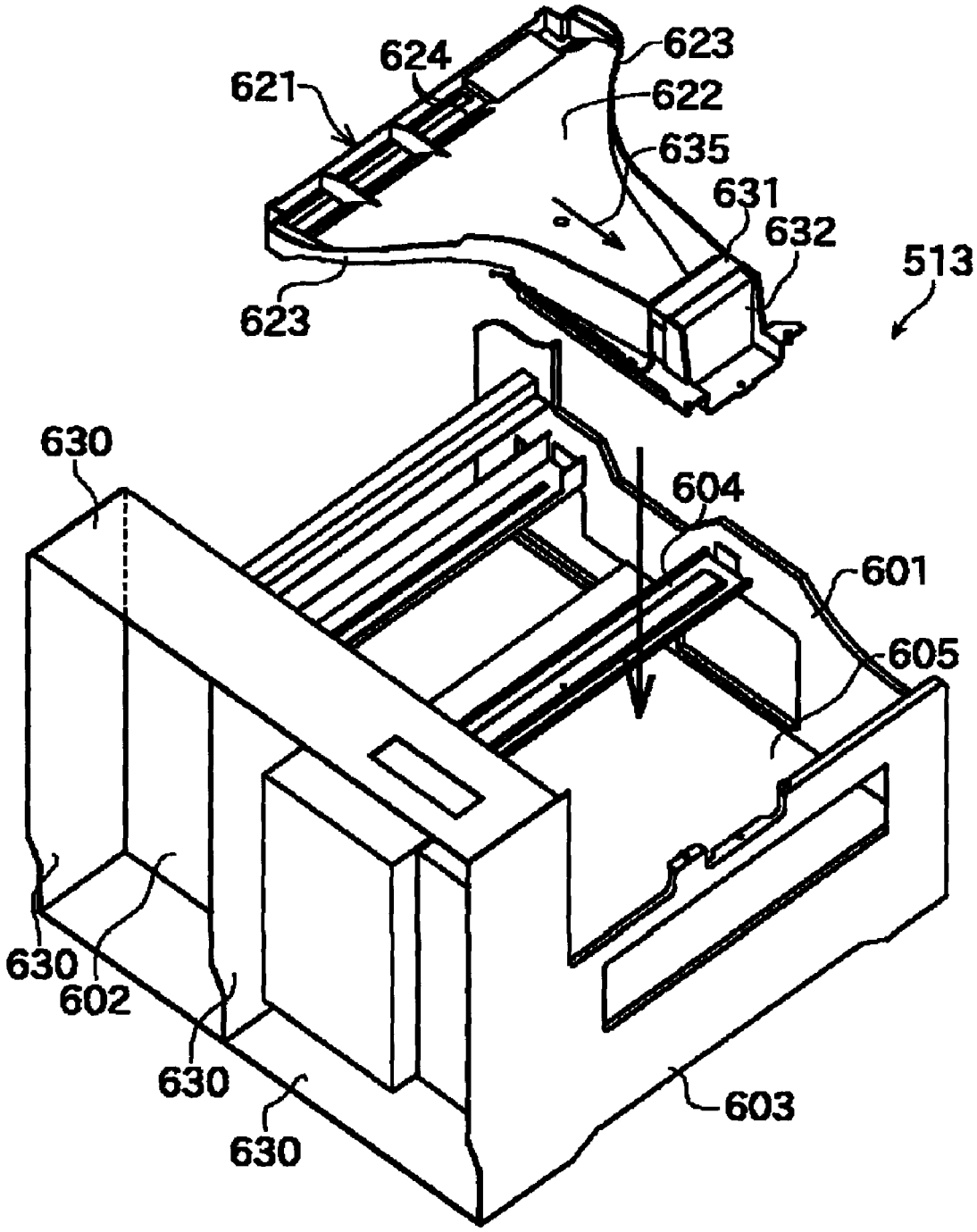
FIG. 4 is a schematic perspective view illustrating a frame configuration of the main body.

Next, a description will be made of frames which define the main body 513 with reference to a schematic perspective view of FIG. 4. As illustrated in FIG. 4, the main body 513 includes a front side frame (a first frame) 601, a rear side frame (a second frame) 602, and a side frame (a third frame) 603. The frames 601, 602, and 603 are vertically arranged. The rear side frame 602 is provided with a plurality of reinforcing frames 630 fixed thereto, and also provided with a driving unit (not illustrated) attached thereto for driving the image forming unit 11, etc.

A middle frame 605 is horizontally arranged between the front side frame 601 and the rear side frame 602. The middle frame 605 connects a middle portion in a height direction of the front side frame 601 and a middle portion in a height direction of the rear side frame 602. Accordingly, the front side frame 601, the rear side frame 602, and the middle frame 605 jointly form a framework which is shaped like a capital "H". As illustrated in FIG. 2, a space for containing the paper feed cassette 514 is arranged on a lower side of the middle frame 605, and a space for containing the image forming unit 11, the fixing portion 91, and a power source unit 18, which supplies power to each unit and portion of the device, etc. is arranged on an upper side of the middle frame 605.

Now, with reference to FIG. 5, a description will be made of a configuration that facilitates assembly of the front side frame 601, the rear side frame 602, and the middle frame 605. The frames 601, 602, and 605 are preferably made of metal plates.

Figure 5A:
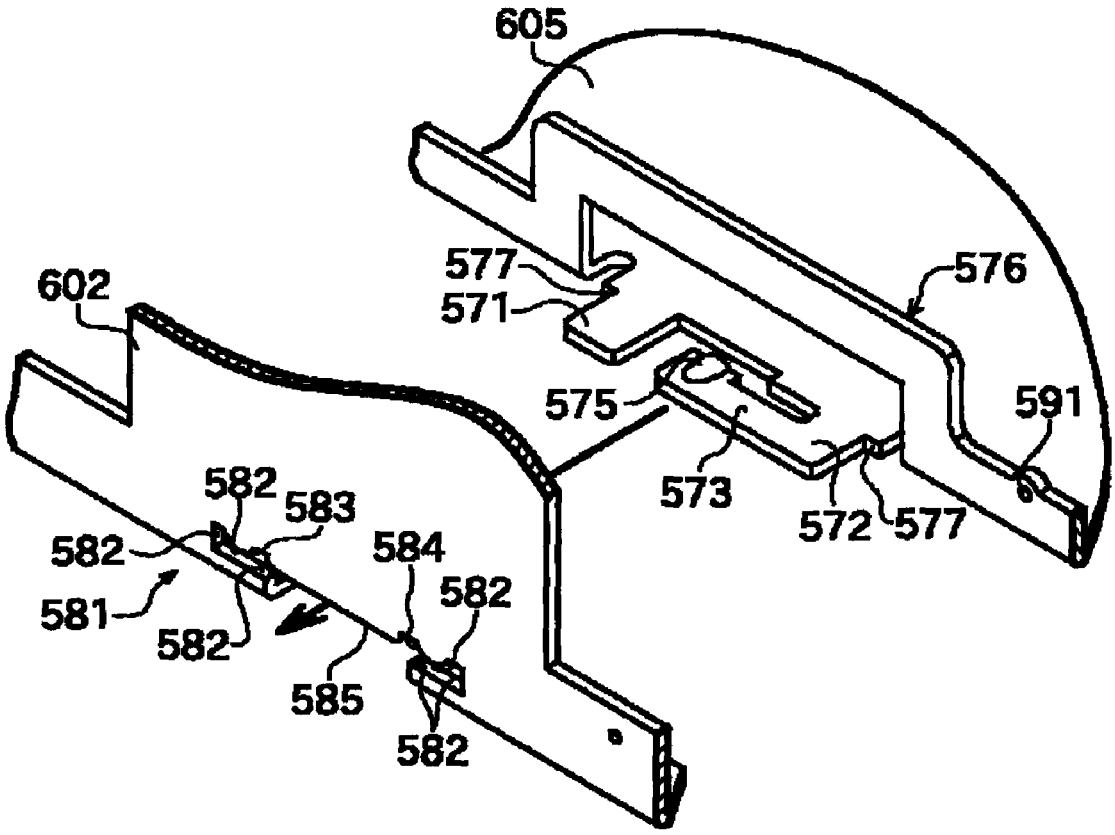
FIG. 5A is a perspective view of a relevant portion illustrating a configuration for temporarily assembling two frames by connecting the frames.

As illustrated in FIG. 5A, at an end portion of the middle frame 605 which is horizontally arranged as a first chassis, a plate-like first protrusion 571 and a plate-like second protrusion 572 are integrally formed such that the first protrusion 571 and the second protrusion 572 protrude parallel or substantially parallel to each other in a horizontal direction. A horizontal plate-like arm 573 is integrally formed such that the plate-like arm 573 extends from a leading end of the second protrusion 572 in a direction at substantially 90 degrees with respect to a protruding direction of the second protrusion 572 (i.e., in a direction extending towards a leading end of the first protrusion 571).

Further, a control protrusion 575 is integrally formed at a leading end portion of the plate-like arm 573 such that the control protrusion 575 protrudes in a thickness direction of the plate-like arm 573. The first protrusion 571, the second protrusion 572, the plate-like arm 573, and the control protrusion 575 are preferably punched out by press working when manufacturing the middle frame 605.

Furthermore, an end portion of the middle frame 605 is bent with an appropriate width to form a vertical portion 576. Moreover, one side of a base portion of the first protrusion 571 and the second protrusion 572 is tiered, and a small contact surface 577 is respectively arranged at each tiered portion. The contact surfaces 577 are substantially vertical to the protruding direction of the first protrusion 571 and the second protrusion 572. The contact surfaces 577 can make contact with an adjacent portion of a recessed portion 581 to be described below. The recessed portion 581 is provided on the rear side frame (a second chassis) 602.

The rear side frame 602 provided as the second chassis includes the punched-out recessed portion 581. The recessed portion 581 preferably has an elongated substantially rectangular shape. The first protrusion 571, the second protrusion 572, and the plate-like arm 573 of the middle frame 605 can be inserted into the recessed portion 581. The recessed portion 581 is preferably punched out by press working when manufacturing the rear side frame 602.

The recessed portion 581 is formed to surround all four sides of the first protrusion 571 and the second protrusion 572, and is provided with a control surface 582 for controlling movement of the inserted first protrusion 571 and second protrusion 572 except for the movement in an inserting direction. The recessed portion 581 is provided on its upper edge with circular protrusions 583 and 584 respectively positioned with respect to the protrusions 571 and 572. The control surface 582 is respectively arranged on a lower end of the protrusions 583 and 584. Furthermore, a latching protrusion 585 is arranged between the circular protrusions 583 and 584 on the upper edge of the recessed portion 581.

The control protrusion 575 arranged on a side of the middle frame 605 protrudes such that a protruding amount thereof gradually increases from a front side in the inserting direction into the recessed portion 581 of the rear side frame 602. A gradual slope is formed on an upper surface of the control protrusion 575.

In the above-described configuration, the first protrusion 571, the second protrusion 572, and the plate-like arm 573 are inserted into the recessed portion 581 in a direction indicated by a heavy-line arrow in FIG. 5A. Since the control surfaces 582 are respectively arranged only at a leading end of the circular protrusions 583 and 584 at the upper edge of the recessed portion 581, friction is not excessively generated upon insertion, and an inserting operation can be smoothly performed.

During the above-described inserting operation, the control protrusion 575 makes contact with the latching protrusion 585. When inserted further, since the gradual slope of the control protrusion 575 is pressed downward by the latching protrusion 585, the plate-like arm 573 is elastically deformed downward. Then, the control protrusion 575 passes through a lower side of the latching protrusion 585. The contact surface 577 of the middle frame 605 makes contact with the rear side frame 602, and almost simultaneously, the control protrusion 575 fully passes the latching protrusion 585. The plate-like arm 573 moves back to its original form by a restoring force, and the control protrusion 575 is latched by the latching protrusion 585 when facing the latching protrusion 585 in the inserting direction.

Figure 5B:
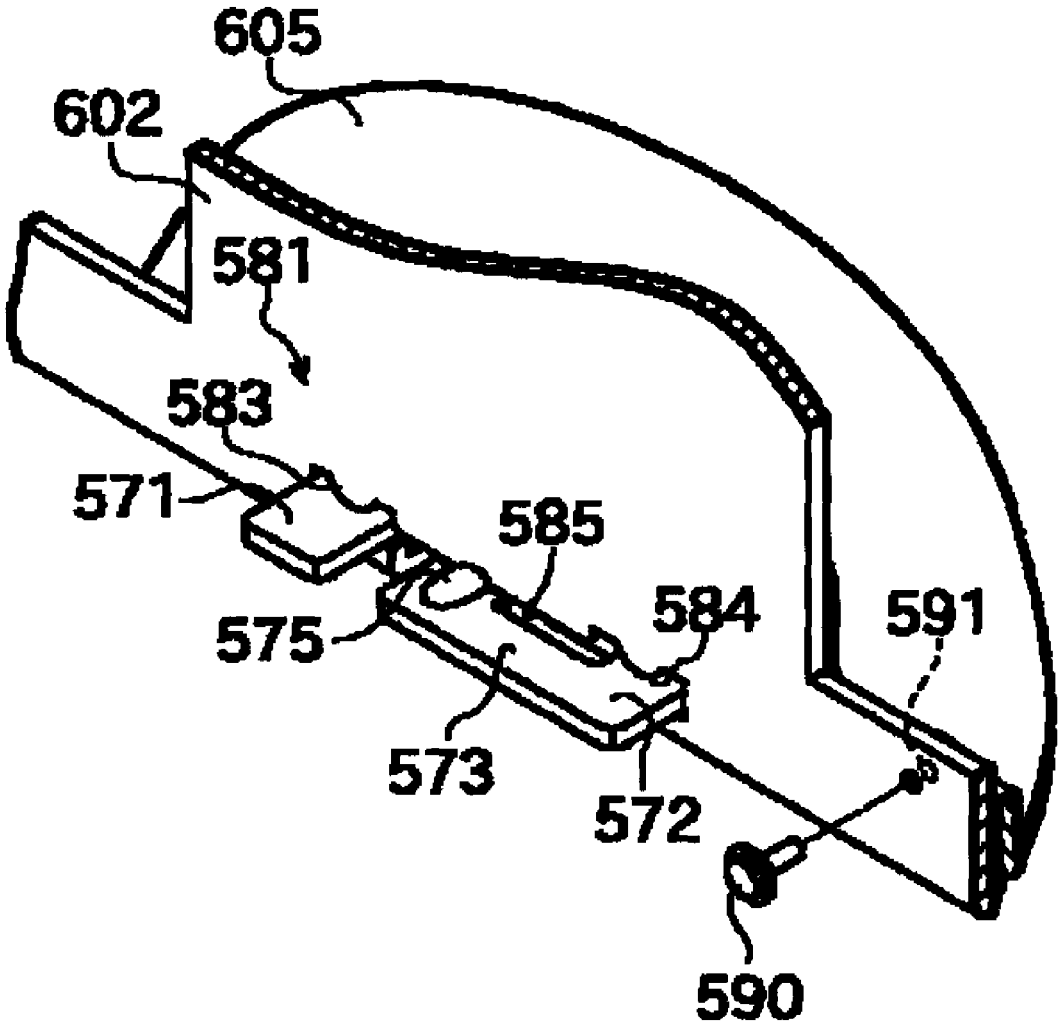
FIG. 5B is a perspective view of a relevant portion illustrating a state in which the frames have been temporarily assembled.

Thus, temporal assembly is carried out as illustrated in FIG. 5B, and the middle frame 605 can be vertically connected to be temporarily assembled without moving or coming off with respect to the rear side frame 602. In addition, a similar connecting configuration illustrated in FIG. 5A is provided between the middle frame 605 and the front side frame 601, and by a similar process, the front side frame 601, the rear side frame 602, and the middle frame 605 can be temporarily assembled in the shape of capital "H". As a result, the rear side frame 602 and the front side frame 601 can independently stand. Accordingly, since an assembly worker does not need to support the rear and front side frames 602 and 601 nor use jigs so that the frames 602 and 601 will not fall, the assembly can be efficiently carried out.

After carrying out the temporal assembly, as illustrated in FIG. 5B, by screwing a tapping screw 590 as an example of a fixing device into a screw fixing hole 591, the rear side frame 602, the front side frame 601, and the middle frame 605 are reliably fixed to each other. In addition, when screwing the tapping screw 590, the middle frame 605 is pressed with a substantial force via the tapping screw 590 for screw cutting of the screw fixing hole 591, however, due to the latching function between the latching protrusion 585 and the control protrusion 575, the rear side frame 602 (or the front side frame 601) does not detach from the middle frame 605 nor fall. Therefore, a fixing operation via the tapping screw 590 can be easily performed.

According to preferred embodiments of the present invention, a tapping screw 590 is preferably used. However, other screws can be used, or any other suitable fixing configuration can also be used. In addition, the temporal assembly illustrated in FIGS. 5A and 5B can be applied not only to a case in which the frames are connected in the shape of a capital "H", but also to a case in which the frames are connected in the shape of a capital "I" or "T", for example. Moreover, shapes, etc. of the first protrusion 571, the second protrusion 572, the plate-like arm 573, and the recessed portion 581 can be changed accordingly.

Now, with reference to FIG. 4 again, a description will be made of a configuration of the frames. As illustrated in FIG. 4, a connecting frame (a fourth frame) 604 is horizontally arranged between the front side frame 601 and the rear side frame 602, which are connected to each other via the middle frame 605. The connecting frame 604 preferably has an elongated shape, and connects the front side frame 601 and the rear side frame 602 by fixing one end of the connecting frame 604 in its longitudinal direction to the front side frame 601, and by fixing the other end to the rear side frame 602 via a fixing device, such as screws (not illustrated).

A synthetic resin-made ventilation duct 621 is substantially horizontally arranged to connect the side frame 603 and the connecting frame 604. The ventilation duct 621 is open on its upper side, and has a lateral wall (a lower wall) 622 and vertical walls 623 and 623 arranged such that the vertical walls 623 and 623 vertically extend respectively from each end of the lateral walls 622. A width of the lateral wall 622 gradually decreases from one end towards the other end of the ventilation duct 621 while a height of the vertical walls 623 and 623 gradually increases from one end towards the other end of the ventilation duct 621.

As illustrated in FIG. 2, one end side of the ventilation duct 621 (i.e., a side on which the width of the lateral wall 622 is greater than the width thereof on the other side) is arranged adjacent to the photoconductive drum 12, the charger 13, and the fixing portion 91, etc. Moreover, the lateral wall 622 has a penetrating circular hole 624 on the end side of the ventilation duct 621. An exhaust fan (an exhaust structure) 631 and an ozone filter 632 are fixed on the other side of the ventilation duct 621. The lateral wall 622 has an intake hole 637 on the other end side of the ventilation duct 621, i.e., at a position adjacent to the power source unit 18.

Accordingly, a substantially horizontal exhaust air stream 635 is provided inside the ventilation duct 621 so that the toner scattered from the photoconductive drum 12, ozone generated by the charger 13, and heated air generated by the fixing portion 91 are discharged via the exhaust air stream 635 by driving the exhaust fan 631. The air in the exhaust air stream 635 eventually passes through a resin cover that covers the main body 513 or through an exhaust hole 636 provided in the paper discharge tray 515, and then, is discharged outwards. Moreover, heated air around the power source unit 18 is also introduced from the intake hole 637 into the ventilation duct 621 and discharged by the exhaust fan 631. Since the ozone generated by the charger 13 is absorbed by the ozone filer 632, ozone is not discharged to the outside of the main body 513.

The paper discharge tray 515 is arranged directly above the ventilation duct 621 and covers the open side of the ventilation duct 621. Accordingly, an upper side of the exhaust air stream 635 is covered by the paper discharge tray 515.

Figure 6:
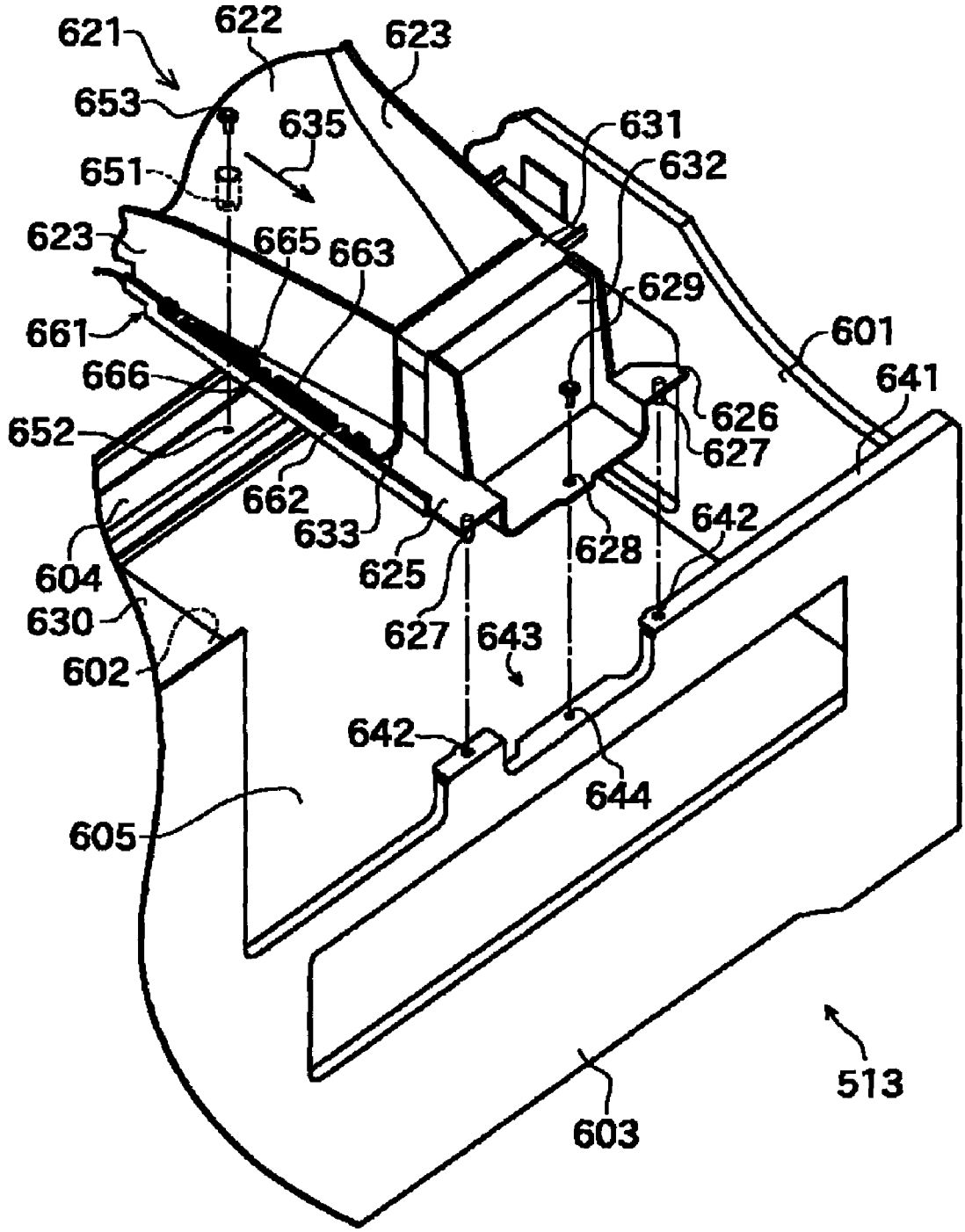
FIG. 6 is an enlarged perspective view illustrating a state in which the frames are being connected by a ventilation duct.

Next, a description will be made in detail of the attachment of the ventilation duct 621 to the side frame 603 and the connecting frame 604. As illustrated in FIG. 6, i.e., in an enlarged view of a relevant portion of FIG. 4, rib portions 625 and 626 are integrally formed at a portion corresponding in position to an end portion on a downstream side of the exhaust air stream 635 such that the rib portions 625 and 626 protrude laterally outward from the vertical walls 623 and 623 arranged at each side of the ventilation duct 621. The rib portions 625 and 626 are positioned slightly higher than the lateral wall 622. A round bar-shaped protrusion 627 protrudes downward from a lower surface of the rib portions 625 and 626. Moreover, the lateral wall 622 is provided with a penetrating inserting hole 628. A shaft portion of a screw 629 can be inserted into the inserting hole 628.

The vertically arranged side frame 603 is bent at its upper end portion with a prescribed width, and is provided with a horizontal portion 641. The horizontal portion 641 is provided with penetrating inserting holes 642 and 642 positioned with respect to the protrusions 627 and 627. The side frame 603 is also provided on its upper end portion with a concave portion 643 arranged between the inserting holes 642 and 642 so that an end portion of the ventilation duct 621 can fit into the concave portion 643. The concave portion 643 is provided with a screw fixing hole 644.

In the above-described configuration, the ventilation duct 621 can be fixed to the side frame 603 by inserting the screw 629 from above through the inserting hole 628 and by fixing the screw 629 to the screw fixing hole 644 under a state in which the protrusions 627 and 627 are inserted from above into the inserting holes 642 and 642.

The ventilation duct 621 is provided with an inserting hole 651 arranged at a middle portion of the ventilation duct 621 (i.e., a middle portion in a direction of the exhaust air stream 635). The connecting frame 604 is provided with a screw fixing hole 652 arranged at a position with respect to the inserting hole 651. Accordingly, the ventilation duct 621 can be fixed to the connecting frame 604 by inserting a screw 653 from above into the inserting hole 651 and fixing the screw 653 to the screw fixing hole 652.

As described above, the side frame 603 and the connecting frame 604 can be connected via the ventilation duct 621. Thus, since the synthetic resin-made ventilation duct 621 also functions as a reinforcing member by connecting the side frame 603 and the connecting frame 604, rigidity of the frame construction can be improved by the simple and lightweight configuration. In addition, since the ventilation duct 621 includes the integrally formed lateral wall 622 and the vertical walls 623 and 623, although the ventilation duct 621 is preferably made of synthetic resin, the ventilation duct 621 can effectively improve the rigidity of the frame construction. In particular, since the ventilation duct 621 is substantially horizontally arranged, the frame construction can endure external forces in a horizontal direction.

In the ventilation duct 621, an elongated harness guide portion 661 is arranged at an edge portion of the rib 625 which protrudes from one of the vertical walls 623. The harness guide portion 661 is provided with a guide wall 662 and an intermittent wall 663 which are arranged parallel or substantially parallel to each other. The guide wall 662 and the intermittent wall 663 are integrally formed such that the walls 662 and 663 protrude upward from an end portion of the rib portion 625. A harness containing space 665 is arranged between the guide wall 662 and the intermittent wall 663. The intermittent wall 663 is provided with a plurality of interspaces arranged intermittently in its longitudinal direction. At each interspaced portion of the intermittent wall 663, a fixing protrusion 666 is arranged to protrude from an upper end portion of the guide wall 662 in a direction towards a side of the intermittent wall 663.

In the above-described configuration, a harness 633 for supplying the exhaust fan 631 with power is placed by being pressed into an inside of the harness containing space 665. As a result, the harness 633 can be protected from catching on other components, etc. Thus, according to the present preferred embodiment of the present invention, since the ventilation duct 621 is also provided as a guide member for the harness 633, the configuration can be more simplified and the number of components can be reduced.

Further, according to the present preferred embodiment of the present invention, the inserting hole 628 and the protrusions 627 are arranged at an end portion on a downstream side of the exhaust air stream 635 of the ventilation duct 621. On the other hand, the side frame 603 is provided with the inserting holes 642. The ventilation duct 621 can be fixed to the side frame 603 by inserting the screw 629 into the inserting hole 628 and fixing the screw 629 to the side frame 603 under a state in which the protrusions 627 of the ventilation duct 621 are inserted into the inserting holes 642. In the above-described configuration, the side frame 603 can be positioned by the protrusions 627 and the inserting holes 642. Moreover, since a plurality of protrusions 627 (for example, two protrusions 627) are provided, the ventilation duct 621 and the side frame 603 can be fixed at many portions (for example, three portions in total) and bending of the side frame 603 can be controlled.

Since the paper discharge tray 515 is arranged as a cover to the upper side of the exhaust air stream 635 (refer to FIG. 2), the paper discharge tray 515 also guides the exhaust air stream 635 along with the ventilation duct 621. Accordingly, the configuration can be more simplified.

Furthermore, more than three or only one protrusion(s) 627 and inserting hole(s) 642 can be provided. However, in order to prevent the side frame 603 from bending, it is preferable that a plurality of protrusions 627 and inserting holes 642 are provided. Moreover, a connecting configuration using the protrusions 627 and the inserting holes 642 can be applied at a connecting portion of the ventilation duct 621 and the connecting frame 604. The shape of the ventilation duct 621 and the position and the shape of the harness guide portion 661 can be changed, if required, to optimize their layout.

Next, a description will be made of the process cartridge 5 with reference to FIG. 7. As illustrated in an external perspective view of FIG. 7, the process cartridge 5 includes a synthetic resin-made housing 201, which supports the photoconductive drum 12 therein such that the photoconductive drum 12 can rotate. As illustrated in FIG. 3, the housing 201 is also provided as the developer container 35 in the developing unit 15 and as a retention container for the remaining toner in the cleaner 17 or the like.

Figure 7:
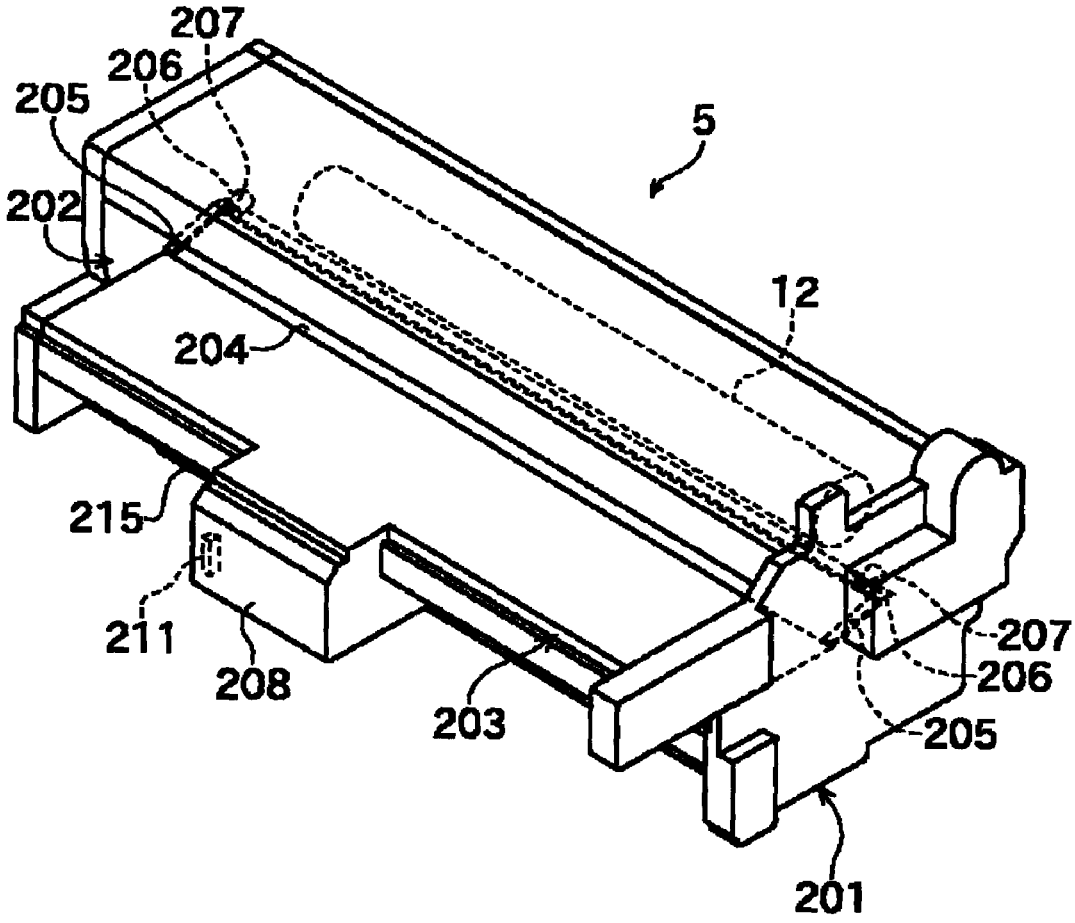
FIG. 7 is an external perspective view illustrating an overall configuration of a process cartridge.

As illustrated in FIG. 7, the housing 201 is provided with an elongated opening 202. The LED head 14 arranged on a side of the main body 513 can be inserted into the opening 202 (refer to FIG. 3). A developing unit cover 203 is arranged on a lower side of the opening 202. The developing unit cover 203 defines a portion of the housing 201, and as illustrated in FIG. 3, the developing unit cover 203 is arranged to cover an upper side of the developer container 35 of the developing unit 15.

As illustrated in FIG. 7, the developing unit cover 203 horizontally extends towards an inner side of the opening 202, and then bends near the photoconductive drum 12. The developing unit cover 203 has a sloped surface 204 beyond the bent portion such that the sloped surface 204 increases in height towards the photoconductive drum 12.

In an inside of the opening 202, upwardly protruding ribs 205 and 205 are respectively provided at each end of the sloped surface 204 (i.e., at each end in an axial direction of the photoconductive drum 12). A longitudinal direction of the rib 205 is arranged substantially parallel to the sloped surface 204. Moreover, positioning hole forming members 206 and 206 are respectively provided at each end side of the photoconductive drum 12. Each positioning hole forming member 206 has a positioning hole 207. Positioning can be performed by inserting a positioning pin 46 (to be described below) into the positioning hole 207. The positioning hole 207 of one of the positioning hole forming members 206 has a round shape to which the positioning pin 46 can be fit into with no space therebetween, and performs the positioning due to its uniformly round shaped in its axial cross section. The positioning hole 207 of the other positioning hole forming member 206 has an elongated hole shape which facilitates the positioning by the positioning pin 46.

The housing 201 of the process cartridge 5 has a small protruding portion 208 protruding in a horizontal direction at a center in the axial direction of the photoconductive drum 12. In the developing unit 15, a concentration sensor (not illustrated) for measuring toner concentration is provided near the protruding portion 208. A first electrical connector 211 is arranged on one side of the protruding portion 208, and can output a signal from the concentration sensor.

Next, a description will be made of a configuration for inserting the process cartridge 5 into the main body 513 with reference to FIG. 8. In a perspective view of a relevant portion in FIG. 8, reference numeral 221 refers to a resin-made interior cover which is fixed to a front side of the front side frame 601 (FIG. 4). The interior cover 221 is exposed when the front cover 521 illustrated in FIG. 1 is opened.

Figure 8:
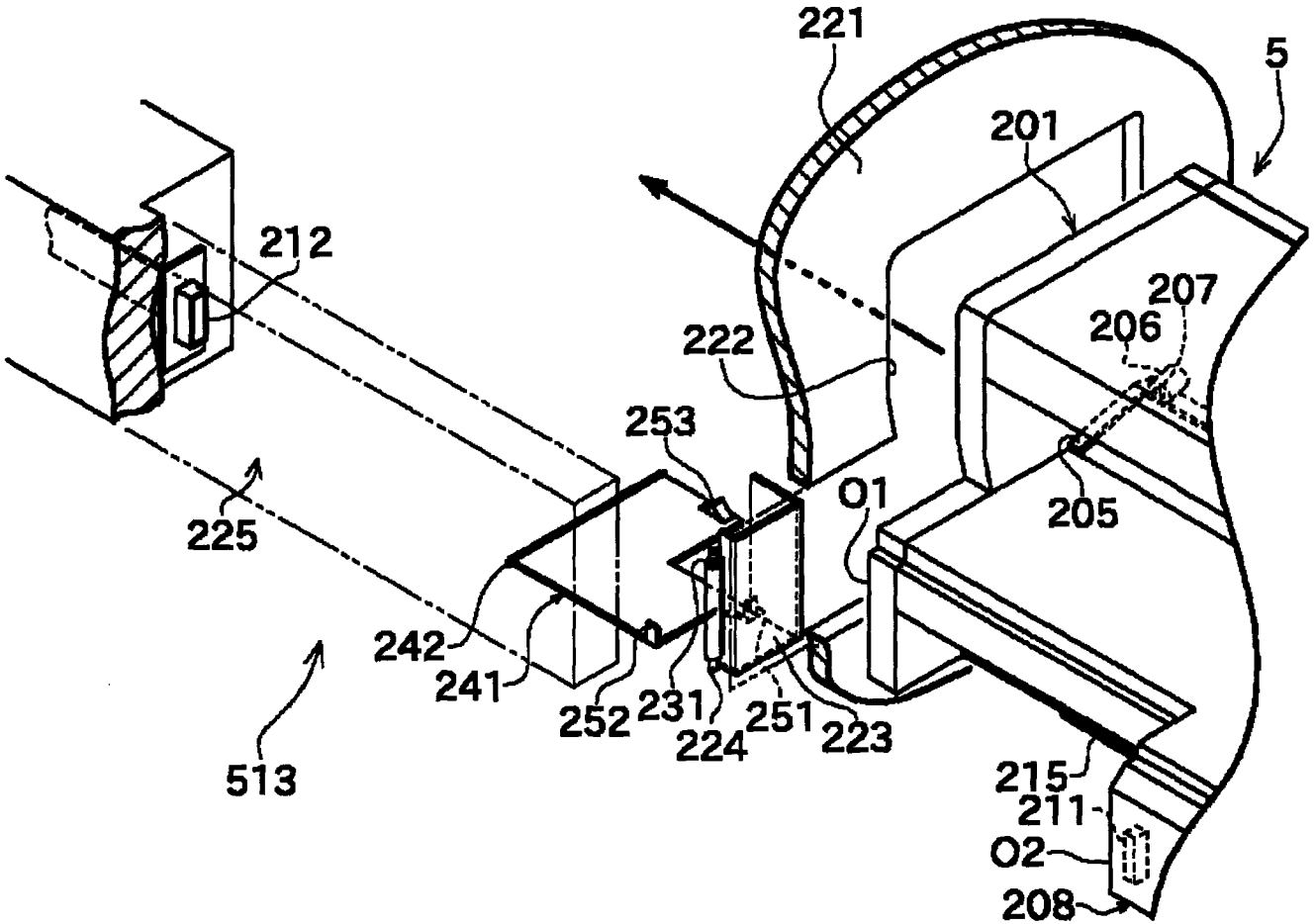
FIG. 8 is a perspective view of a relevant portion illustrating a state in which the process cartridge is being inserted into the main body through an opening.

As illustrated in FIG. 8, the interior cover 221 has an insertion opening 222 into which the process cartridge 5 is inserted. An (overall) contour of the insertion opening 222 is substantially identical to a contour O2 of the process cartridge 5 including the protruding portion 208. An insertion space 225 for the process cartridge 5 is arranged inside the main body 513 beyond the interior cover 221. A second electrical connector 212 which can be electrically connected to the first electrical connector 211 is provided inside the insertion space 225.

An opening and closing door 223 is arranged on a side of the main body 513 so as to partially close the insertion opening 222. The opening and closing door 223 is rotatably pivoted around a vertical shaft 224. The opening and closing door 223 can be switched between a closed position illustrated in FIG. 8 and an open position where the opening and closing door 223 is swung from the closed position to an inside of the main body 513 (refer to FIG. 10). Moreover, the opening and closing door 223 is provided with a biasing spring (a first biasing member) 231 which biases the opening and closing door 223 towards the closed position.

Inside the main body 513 beyond the opening and closing door 223, a control flapper (a control member) 241 is arranged at a lower side of the insertion space 225. The control flapper 241 has a plate-like shape and is rotatably pivoted around a horizontal shaft 242 on its one end. Thus, the control flapper 241 can be switched between a control position illustrated in FIG. 8 and a releasing position where the control flapper 241 is pivoted downward from the control position (refer to FIG. 9). Although not illustrated, the control flapper 241 is provided with a biasing spring (a second biasing member) which biases the control flapper 241 towards the control position.

A first control claw (a first protrusion) 251 and a second control claw (a second protrusion) 252 are arranged on an upper surface of the control flapper 241 such that the first control claw 251 and the second control claw 252 protrude upward. The first control claw 251 and the second control claw 252 make contact with a lower portion of the opening and closing door 223 so that the first and second claws 251 and 252 can control the swinging of the opening and closing door 223.

A control releasing cam 253 is arranged on the upper side of the control flapper 241 such that the control releasing cam 253 protrudes upward. The control releasing cam 253 has a gradually sloping pushing surface. On the other hand, a pushing rib 215 is arranged to protrude from a lower surface of the housing 201 of the process cartridge 5. When the process cartridge 5 is inserted into the insertion opening 222, the pushing rib 215 makes contact with the control releasing cam 253. A longitudinal direction of the pushing rib 215 is arranged along an inserting direction of the process cartridge 5.

In the above-described configuration, FIG. 8 illustrates a state in which the process cartridge 5 is to be inserted into the main body 513. Under the state of FIG. 8, the opening and closing door 223 is positioned at the closed position, and the control flapper 241 is positioned at the upper control position by the biasing spring (not illustrated). Accordingly, the first control claw 251 of the control flapper 241 is in contact with the lower portion of the opening and closing door 223 to control the swinging of the opening and closing door 223.

Under the state of FIG. 8, the process cartridge 5 is inserted into the insertion opening 222 in a direction that is parallel or substantially parallel to the axial direction of the photoconductive drum 12. Since the insertion opening 222 is partially closed by the opening and closing door 223 under the state of FIG. 8, the contour of the insertion opening 222 is substantially identical to a contour O1 of a front portion of the process cartridge 5 in the inserting direction. Therefore, since a user can adjust the contour O1 of the front portion of the process cartridge 5 to the contour of the insertion opening 222, the process cartridge 5 can be easily inserted without any trouble in positioning the process cartridge 5.

Figure 9:
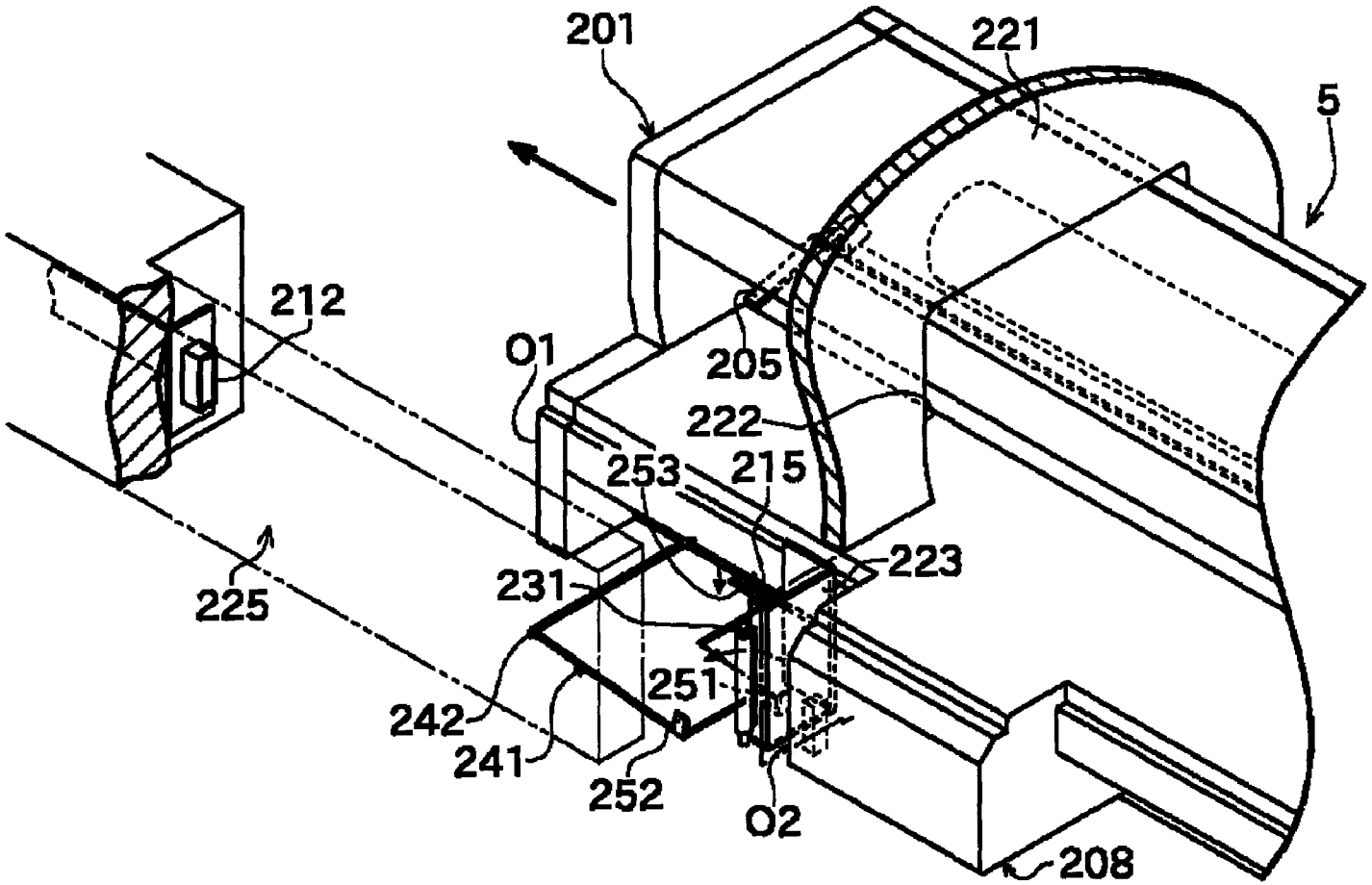
FIG. 9 is a perspective view of a relevant portion illustrating a state in which control of an opening and closing door has been released by a control flapper when the process cartridge is inserted from a state shown in FIG. 8.

As illustrated in FIG. 9, when the process cartridge 5 is being inserted into the insertion space 225, the pushing rib 215 makes contact with the control releasing cam 253 of the control flapper 241. Accordingly, the control flapper 241 is pushed downward via the pushing surface of the control releasing cam 253. Thus, since the control flapper 241 turns downward against the biasing spring (not illustrated) to be positioned at the releasing position, contact between the first control claw 251 and the opening and closing door 223 is eliminated. As a result, the opening and closing door 223 can be switched to the open position. In addition, since the pushing rib 215 has an elongated shape, the control flapper 241 can be maintained under a control released state until the process cartridge 5 is inserted to a certain point from a state shown in FIG. 9.

Figure 10:
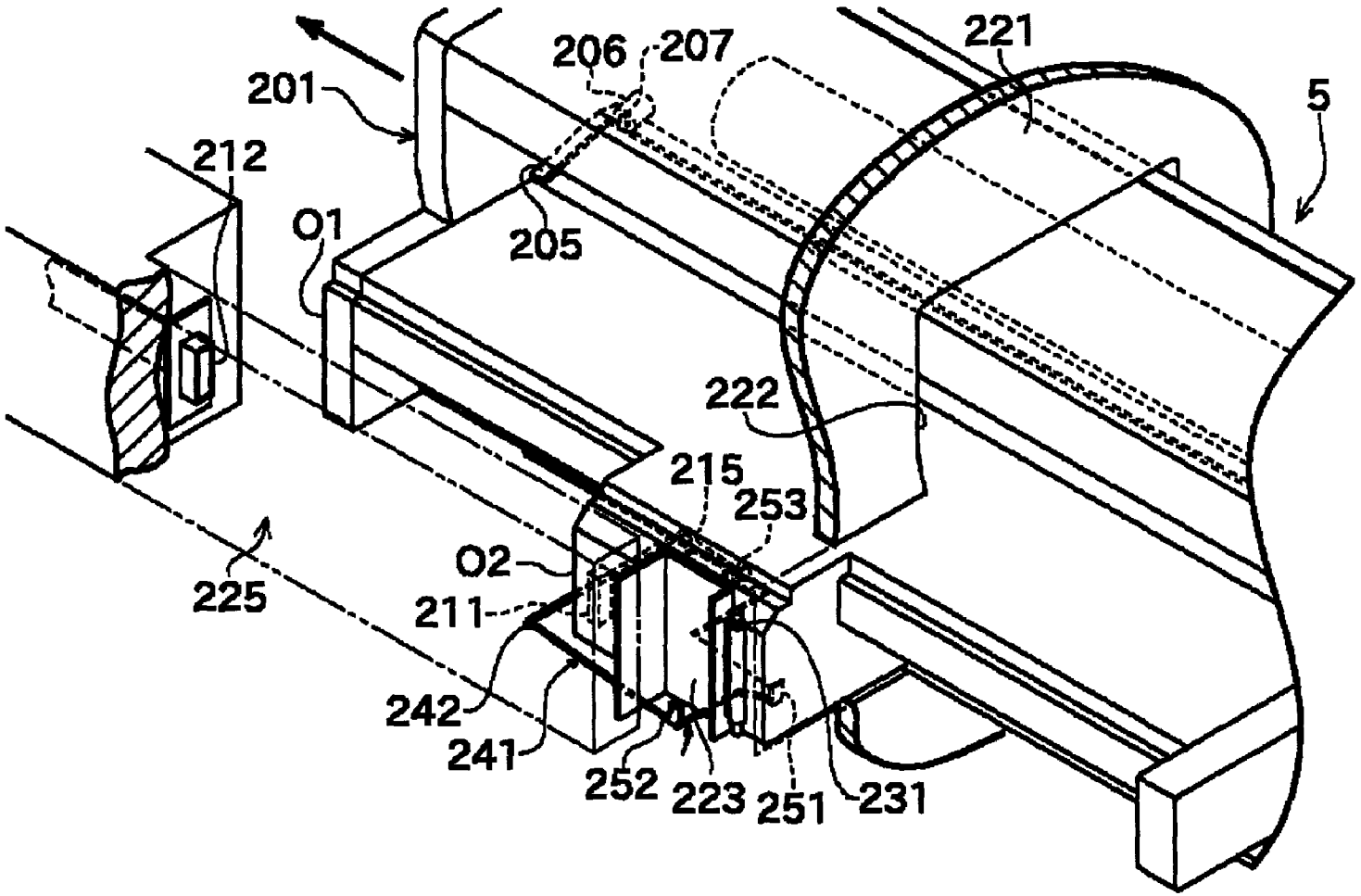
FIG. 10 is a perspective view of a relevant portion illustrating a state in which a protruding portion of the process cartridge is pushing and opening the opening and closing door to pass through the opening when the process cartridge is inserted further from a state shown in FIG. 9.

As illustrated in FIG. 10, when the process cartridge 5 is further inserted into the insertion space 225, the protruding portion 208 of the process cartridge 5 makes contact with the opening and closing door 223, and pushes towards a side of the insertion space 225. As a result, the protruding portion 208 pushes and opens the opening and closing door 223 to the open position, and can pass through the insertion opening 222.

When the process cartridge 5 is inserted slightly further from a state of FIG. 10, the pushing rib 215 passes a portion where the control releasing cam 253 is provided. As a result, the control flapper 241 is turned upward by the biasing spring (not illustrated) as indicated by an arrow, and returned to the control position. Accordingly, since the second control claw 252 makes contact with the lower portion of the opening and closing door 223 in the open position, the opening and closing door 223 is controlled at the open position by the control flapper 241 and is fixed at the open position after the protruding portion 208 passes through the insertion opening 222.

When the process cartridge 5 is inserted further from the state of FIG. 10, a state is established in which most portions of the process cartridge 5 are inside the insertion space 225. Thus, insertion of the process cartridge 5 into the main body 513 is completed. At this time, since the first electrical connector 211 of the process cartridge 5 is electrically connected to the second electrical connector 212 on the side of the main body 513, a signal indicating the toner concentration in the developing unit 15 of the process cartridge 5 is recognized at a control unit (not illustrated) provided in the copy-and-facsimile MFP 501.

As described above, according to the present preferred embodiment of the present invention, although the contour O2 (the contour including the protruding portion 208) at a middle portion of the process cartridge 5 is larger than the contour O1 at an end portion of the process cartridge 5, the process cartridge 5 can be easily inserted only by adjusting the contour O1 at the end portion to the contour of the insertion opening 222 (the contour under a state in which the insertion opening 222 is partially closed by the opening and closing door 223). Thus, a portion of the large contour O2 can smoothly pass through the insertion opening 222 by pushing and opening the opening and closing door 223. Accordingly, an inserting operation of the process cartridge 5 can be easily performed. In addition, since the opening and closing door 223 is controlled at the open position under a state in which the process cartridge 5 is completely inserted, the opening and closing door 223 does not obstruct when the protruding portion 208 passes through upon removing the process cartridge 5.

When removing the process cartridge 5 from the main body 513, an operation reverse to the above described operation can be carried out. That is, when the process cartridge 5 is being drawn out from the insertion opening 222, while the protruding portion 208 passes through the insertion opening 222, the pushing rib 215 pushes the pushing surface of the control releasing cam 253 downward. Thus, the control flapper 241 turns downward from the control position to the releasing position. As a result, since the control by the second control claw 252 of the control flapper 241 is released, the opening and closing door 223 can be switched to the closed position. Then, the protruding portion 208 passes through the insertion opening 222 completely, and simultaneously the opening and closing door 223 is switched to the closed position by the biasing force of the biasing spring 231. When the process cartridge 5 is drawn out further, the pushing rib 215 passes the control releasing cam 253. Thus, the control flapper 241 is turned upward to the control position by the biasing spring (not illustrated). As a result, since the first control claw 251 makes contact with the lower portion of the opening and closing door 223 positioned at the closed position, the opening and closing door 223 is controlled at the closed position by the control flapper 241.

As described above, when removing the process cartridge 5, the portion of the large contour O2 including the protruding portion 208 passes through the insertion opening 222, and simultaneously, the opening and closing door 223 is closed. Then, the opening and closing door 223 is controlled to be at the closed position. Accordingly, when inserting the process cartridge 5 again after its removal, the process cartridge 5 can be easily inserted only by adjusting the contour O1 at the end portion to the contour of the insertion opening 222 (i.e., the contour of the insertion opening 222 when the insertion opening 222 is partially closed by the opening and closing door 223).

The control flapper 241 is provided with the first control claw 251 and the second control claw 252. The first control claw 251 makes contact with the opening and closing door 223 positioned at the closed position. The second control claw 252 makes contact with the opening and closing door 223 positioned at the open position. Therefore, the opening and closing door 223 can be controlled at each of the positions with a simple configuration.

The control flapper 241 is also provided with the control releasing cam 253 arranged on its surface facing the process cartridge 5 (i.e., a surface facing the insertion space 225, that is, an upper surface of the control flapper 241). The control releasing cam 253 has the sloped pushing surface. Moreover, the pushing rib 215 for pushing the control flapper 241 via the control releasing cam 253 is arranged on a surface (the lower surface) of the process cartridge 5 that faces a side of the control flapper 241. The longitudinal direction of the pushing rib 215 is arranged along the inserting direction of the process cartridge 5. Therefore, by setting a length and a position of the pushing rib 215 accordingly, it is easy to set the right time to control or release the control of the opening and closing door 223 when inserting the process cartridge 5.

According to the present preferred embodiment of the present invention, since the protruding portion 208 of the process cartridge 5 is provided with the first electrical connector 211, the second electrical connector 212 is arranged on the side of the main body 513. When the process cartridge 5 is inserted into the main body 513, the first electrical connector 211 is electrically connected to the second electrical connector 212. Accordingly, when the toner concentration sensor is arranged near the protruding portion 208, the electrical wiring can be simplified. Moreover, the toner concentration can be reliably detected on the main body side when the process cartridge 5 is inserted into the main body 513.

Alternatively, for example, the opening and closing door 223 and the control flapper 241 may be arranged such that the opening and closing door 223 and the control flapper 241 can move in parallel or substantially parallel instead of being able to turn. Furthermore, the shape of the housing 201 and the protruding portion 208, the shape and the position of the opening and closing door 223, the shape of the insertion opening 222, the shape and the position of the control flapper 241, and the position and the shape of the control claws 251 and 252, etc. can be accordingly modified as necessary.

Next, a detailed description will be made of a configuration for positioning the LED head 14 adjacent to or apart from the photoconductive drum 12. That is, as described above, the photoconductive drum 12, the charger 13, the developing unit 15, and the cleaner 17 are integrally provided as the process cartridge 5, and can be removed from the main body 513 and exchanged if required. However, as illustrated in FIG. 3, the photoconductive drum 12 and the LED head 14 are positioned adjacent to each other when forming an image. Accordingly, if the process cartridge 5 is inserted or removed under such a state (FIGS. 8 to 10), the LED head 14 may be damaged. In order to overcome such a problem, the copy-and-facsimile MFP 501 according to the present preferred embodiment of the present invention is provided with an LED head supporting mechanism 41 which can position the LED head 14 away from the photoconductive drum 12 if required.

Figure 11:
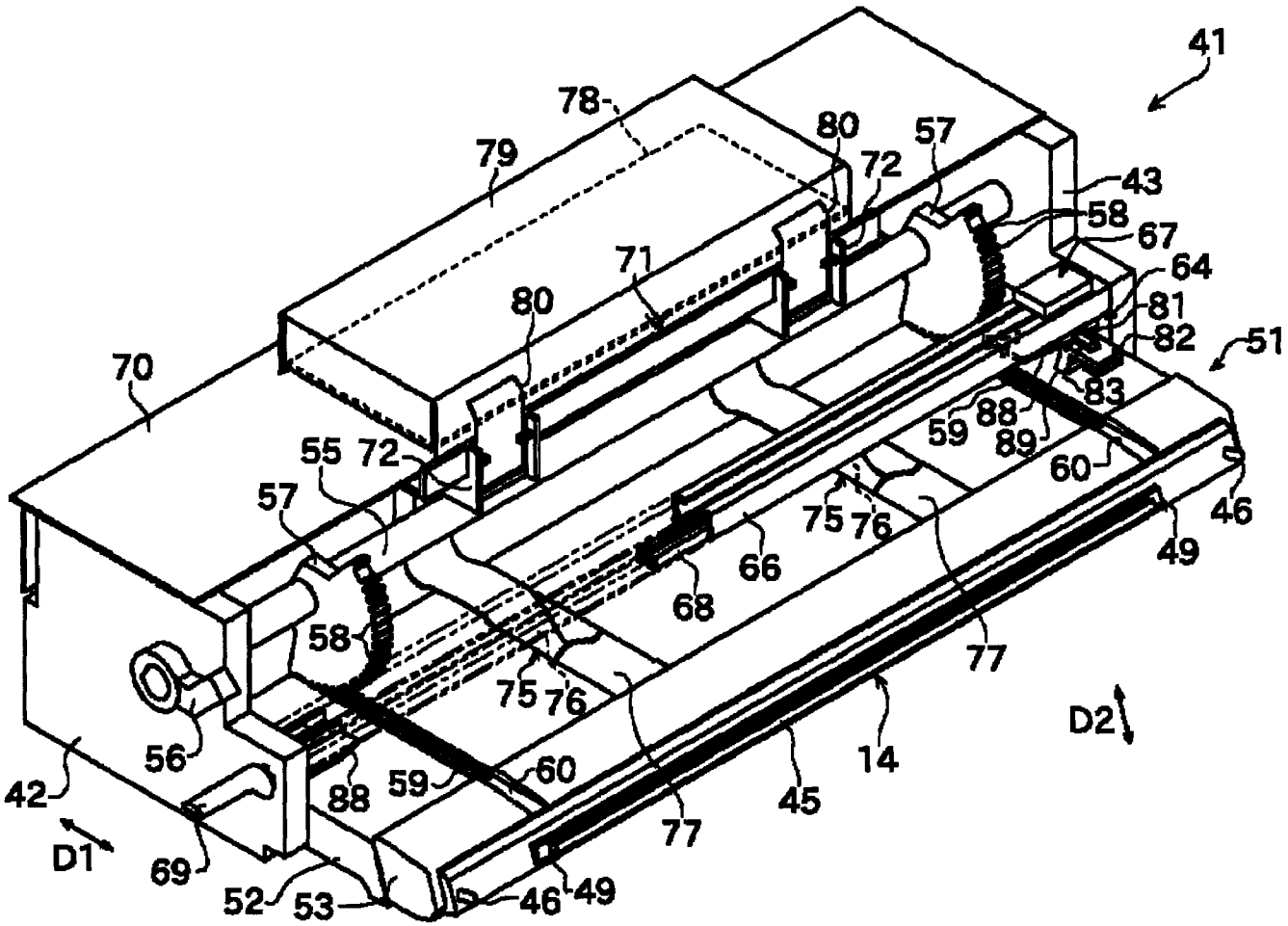
FIG. 11 is an external perspective view of an LED head supporting mechanism.
Figure 12:
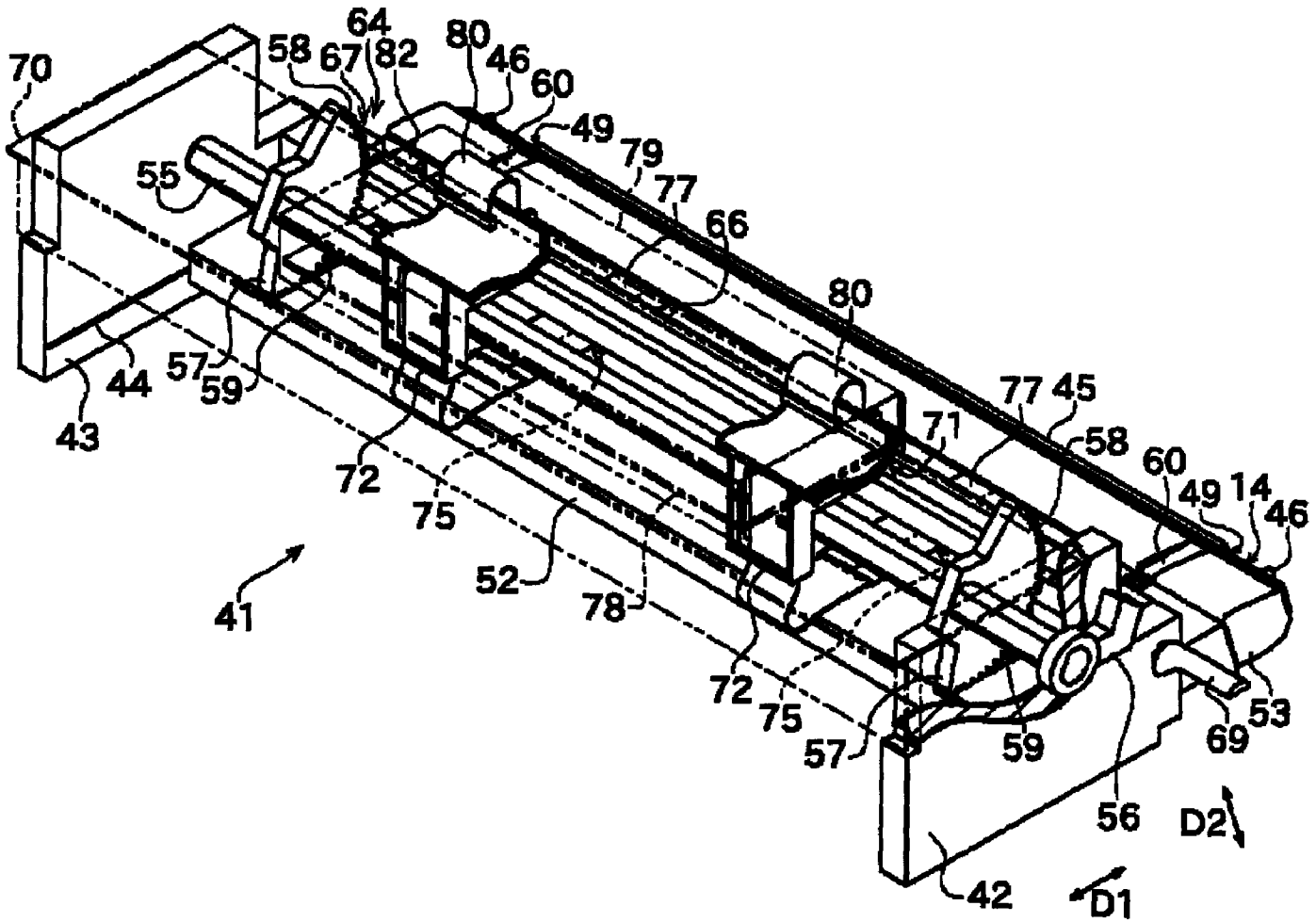
FIG. 12 is an external perspective view of the LED head supporting mechanism viewed from a direction different from a direction of FIG. 11.
Figure 13:
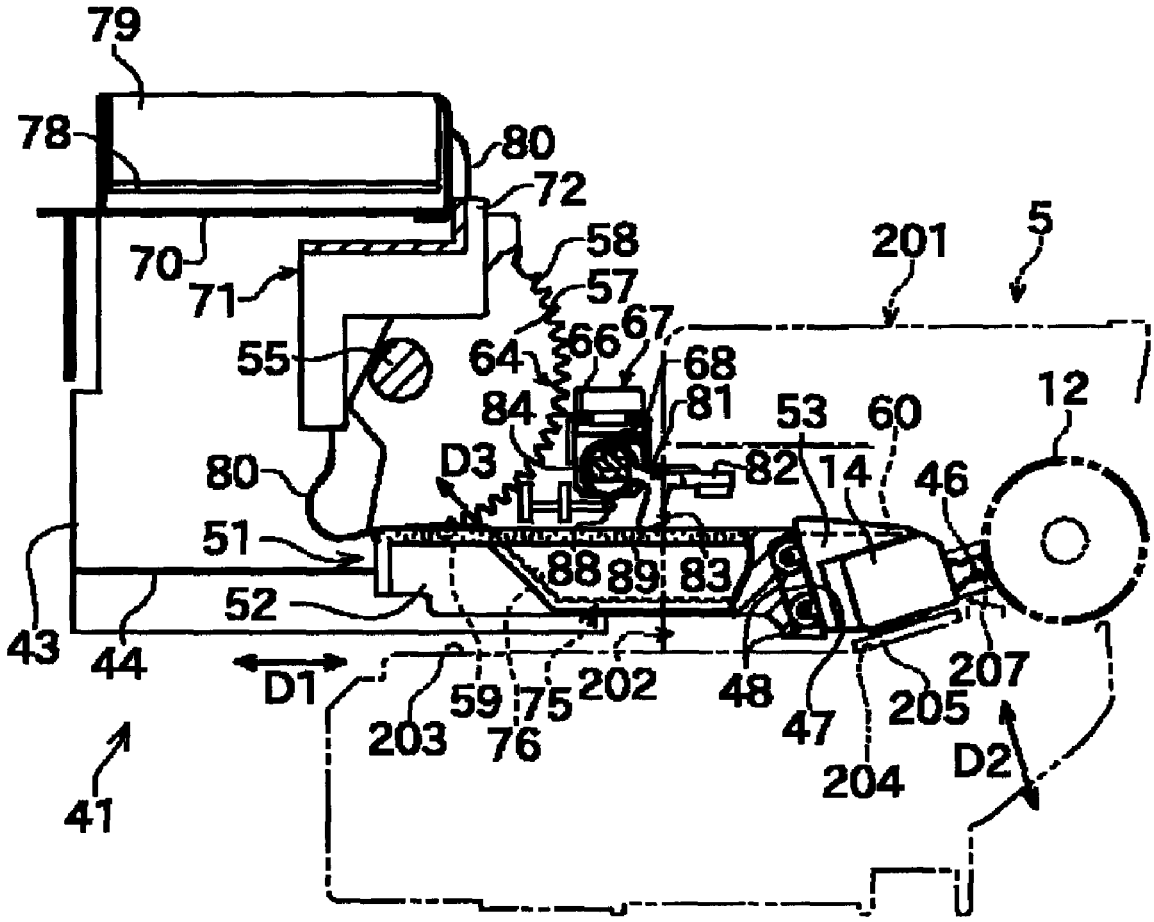
FIG. 13 is a front view of the LED head supporting mechanism under a state in which a slide member is positioned at an adjacent position.

FIGS. 11 and 12 are external perspective views of the LED head supporting mechanism 41 viewed from different directions. FIG. 13 is a front view of the LED head supporting mechanism 41 under a state in which a slide member is positioned at an adjacent position. As illustrated in FIGS. 11 and 12, the LED head supporting mechanism 41 is provided with LED supporting frames 42 and 43 arranged parallel or substantially parallel to each other. As illustrated in FIG. 12, a guide rail 44 is provided on mutually facing surfaces of the LED supporting frames 42 and 43.

A slide member 51 is arranged between the LED supporting frames 42 and 43. The LED head 14 is attached to the slide member 51. The slide member 51 is provided with a base side member 52 and a leading end side member (a head holder) 53, which are preferably made of synthetic resin (in the present preferred embodiment, a acrylonitrile butadiene styrene resin). The base side member 52 has a slightly elongated substantially rectangular shape. Both end portions of the base side member 52 in its longitudinal direction are supported with respect to the LED supporting frames 42 and 43 via the guide rail 44. Thus, the base side member 52 can slide along the guide rail 44 in a horizontal direction (a first direction D1).

The leading end side member 53 is connected to an end portion of the base side member 52 on a side closer to the photoconductive drum 12. The LED head 14 is attached to a leading end portion of the leading end side member 53. As illustrated in FIG. 13, a leading end side of the LED head 14 is elevated slightly obliquely upward from the horizontal direction. Therefore, a light irradiating direction with respect to the photoconductive drum 12 faces obliquely upward. As illustrated in FIG. 11, a lens array 45 in which a plurality of gradient index lens are aligned is arranged on a surface of the LED head 14. In the LED head 14, an uneven portion (a corner portion) 49 is arranged near each end in a longitudinal direction of the lens array 45.

The positioning pin (a positioning body) 46 is fixed to the LED head 14 at each end thereof in the longitudinal direction. The positioning pin 46 extends parallel or substantially parallel to a direction of the LED head 14 (i.e., parallel or substantially parallel to the light irradiating direction). The positioning pin 46 can accurately position the LED head 14 with respect to the photoconductive drum 12 by being inserted into the positioning hole 207 provided on the positioning hole forming member (a counterpart member) 206 of the process cartridge 5. The positioning pin 46 has a round-bar shape with a hemispherical portion at its leading end, and positions the LED head 14 due to a cylindrical portion (a positioning portion) which has a uniform round shape in its axial cross section.

As illustrated in FIG. 13, a guide plane 47 is arranged at a leading end portion of the base side member 52. The guide plane 47 is arranged in a direction vertical to the light irradiating direction of the LED head 14 (i.e., in a direction perpendicular to the positioning pin 46). On the other hand, the leading end side member 53 is preferably provided with a plurality of polyacetal cylindrical rotating rollers (rolling body) 48 such that the cylindrical rotating rollers 48 are rotatably supported and can roll on the guide plane 47. Accordingly, the leading end side member 53 can move with respect to the base side member 52 in a direction along the guide plane 47, i.e., in a direction (a second direction D2) slightly oblique to the vertical direction.

As illustrated in FIGS. 11 and 12, a metallic operation transmission shaft 55 is arranged between the LED supporting frames 42 and 43 such that the operation transmission shaft 55 is rotatably supported. One end of the operation transmission shaft 55 penetrates and extends through the LED supporting frame 42. An operation lever (an operation member) 56 is fixed to a leading end of the operation transmission shaft 55. On the other hand, the other end of the operation transmission shaft 55 penetrates and extends through the LED supporting frame 43. A biasing spring (not illustrated) is attached to the other leading end of the operation transmission shaft 55.

Pinion gears 57 and 57 are fixed to each end portion of the operation transmission shaft 55. The pinion gears 57 and 57 are provided with a plurality of teeth 58 aligned in an arc. The pinion gears 57 and 57 preferably include identical components. The operation transmission shaft 55 has a shape of a capital "D" in its cross section. The pinion gears 57 and 57 are arranged similarly in phase and fixed to the operation transmission shaft 55.

A rack 59 is respectively arranged on a surface (an upper surface) of the base end member 52 of the slide member 51 such that each of the racks 59 respectively engages with the pinion gears 57 and 57. The racks 59 and 59 are provided as a pair, and respectively have teeth similarly positioned with respect to each other. A top surface of rack 59 having gear teeth is flush with the surface of the base side member 52 (i.e., there is no difference in height between the top surface and the surface of the base side member 52). A base surface of the teeth is concave from the surface of the base side member 52. In addition, the leading end side member 53 of the slide member 51 is provided with a linear concave groove 60 arranged such that the concave groove 60 extends from an end portion of the rack 59.

Figure 14:
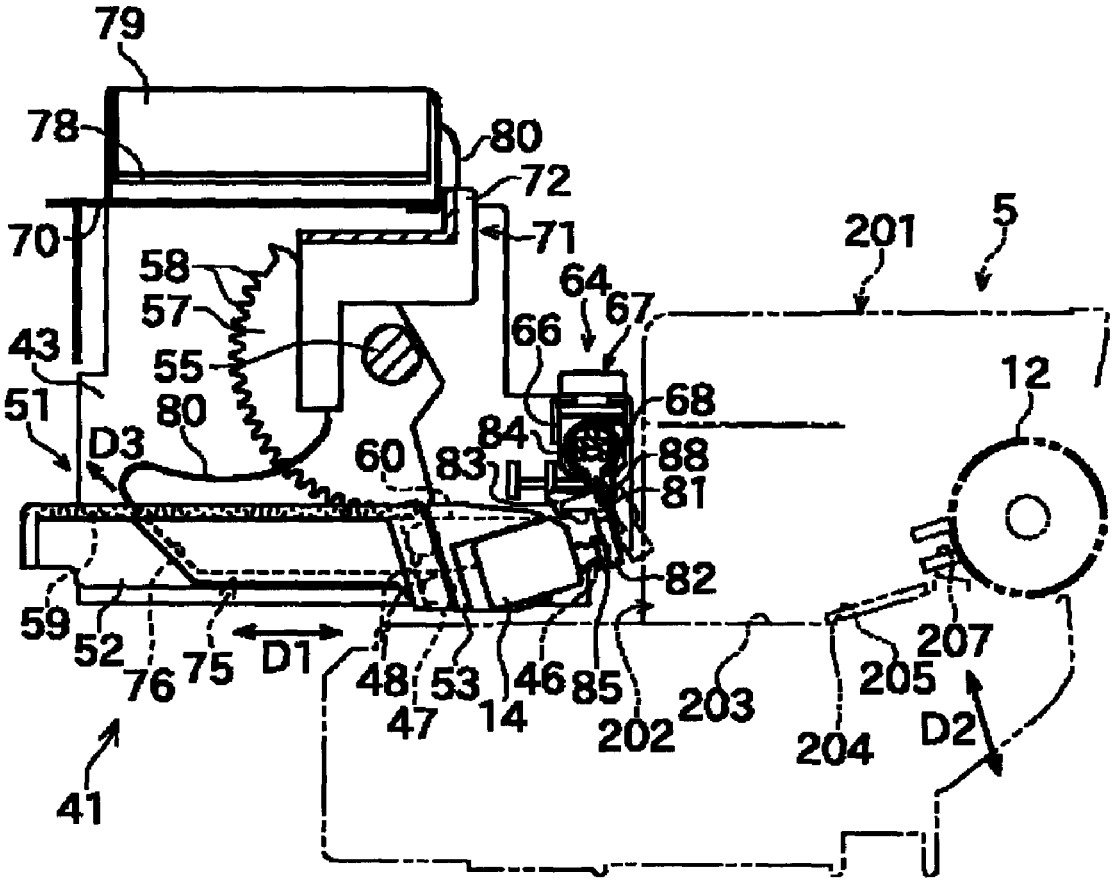
FIG. 14 is a front view of the LED head supporting mechanism under a state in which the slide member is positioned at a distant position.

FIGS. 11 through 13 illustrate a state in which the LED head 14 is positioned adjacent to the photoconductive drum 12. A position of the slide member 51 in the above-described state will be hereinafter referred to as an adjacent position. When a user performs a rotating operation of the operation lever 56 from the above-described state, such operational force is transmitted to the pinion gear 57 via the operation transmission shaft 55. Accordingly, accompanying rotation of the pinion gear 57, the slide member 51 retracts along the first direction D1 from the photoconductive drum 12. As a result, as illustrated in FIG. 14, the LED head 14 can be positioned apart from the photoconductive drum 12. A position of the slide member 51 under the above-described state will be hereinafter referred to as a distant position. Thus, by operating the operation lever 56, the slide member 51, and consequently, the LED head 14 can also be switched between the adjacent position and the distant position.

As illustrated in FIGS. 11 and 12, a metallic supporting plate 70 is fixed between the LED supporting frames 42 and 43 to connect each upper end thereof. A circuit board 78 is arranged on an upper surface of the supporting plate 70 to control the LED head 14. A cover 79 is arranged to cover and guard the circuit board 78. As illustrated in FIG. 13, the circuit board 78 is positioned opposite the slide member 51 across the operation transmission shaft 55.

A flexible flat cable 80 extends from the circuit board 78. The flexible flat cable 80 electrically connects the circuit board 78 and the LED head 14.

A cable guiding member 71 is fixed to the supporting plate 70 and arranged between the circuit board 78 and the slide member 51. The cable guiding member 71 is provided with two guide portions 72 and 72 for guiding the flexible flat cable 80. Each of the guide portions 72 is positioned adjacent to the operation transmission shaft 55. The cable guiding member 71 is preferably made of an insulating synthetic resin, and as illustrated in FIG. 11, the cable guiding member 71 is integrally formed to connect the guide portions 72 and 72.

As illustrated in FIG. 13, each of the guide portions 72 has a stepped shape, and guides the flexible flat cable 80 along each stepped shaped path. An end portion (a lower end portion) of the guide portion 72 on a side of the slide member 51 is positioned closer to the slide member 51 than the operation transmission shaft 55.

As illustrated in FIG. 11, the base side member 52 of the slide member 51 is provided with a cable containing groove 75 for containing the flexible flat cable 80. The cable containing groove 75 is concavely arranged on the upper surface of the base side member 52 such that the cable containing groove 75 is open on a side close to the cable guiding member 71. As illustrated in FIG. 13, a sloped guide surface (a guide surface) 76 is arranged on one side of the cable containing groove 75. The flexible flat cable 80 is guided by the sloped guide surface 76 such that the flexible flat cable 80 is extends from the upper surface of the slide member 51 in an obliquely upward direction (a third direction D3) apart from the photoconductive drum 12 towards the circuit board 78.

As illustrated in FIG. 11, a lid cover 77 is provided to close the open side of the cable containing groove 75. A surface of the lid cover 77 is flush with the surface of the base side member 52.

As described above, the flexible flat cable 80 can be guided by the guide portion 72 of the cable guiding member 71 so that the flexible flat cable 80 does not make contact with the metallic supporting plate 70 and the operation transmission shaft 55. Accordingly, electrical noise can be prevented from intruding into a control signal that moves down a signal line provided in the flexible flat cable 80, and erroneous operations of the LED head 14 can be avoided. Moreover, the flexible flat cable 80 can avoid being damaged by scraping against the operation transmission shaft 55.

Further, the end portion of the cable guiding member 71 on the side of the slide member 51 is positioned closer to the slide member 51 than the operation transmission shaft 55. Therefore, the flexible flat cable 80 can be reliably prevented from making contact with the operation transmission shaft 55.

Furthermore, the cable guiding member 71 has the stepped shape so that the cable guiding member 71 does not interfere with the operation transmission shaft 55. The cable guiding member 71 is positioned adjacent to the operation transmission shaft 55. Therefore, a space adjacent to the operation transmission shaft 55 can be effectively utilized as space for placing the flexible flat cable 80. Moreover, the LED head supporting mechanism 41 can be downsized.

The end portion of the cable guiding member 71 on the side of the slide member 51 is positioned farther apart from the photoconductive drum 12 than the operation transmission shaft 55. Therefore, even if the flexible flat cable 80 is loosened due to movement of the slide member 51, the flexible flat cable 80 can be reliably prevented from making contact with the operation transmission shaft 55.

With respect to a cleaning mechanism 64 of the LED head 14 to be described below, the end portion of the cable guiding member 71 on the side of the slide member 51 is positioned on a side closer to the slide member 51 than to the cleaning mechanism 64, and positioned on a side farther from the photoconductive drum 12 than the cleaning mechanism 64. Therefore, the flexible flat cable 80 can be prevented from making contact with the cleaning mechanism 64, and consequently, signal noise or damage of the flexible flat cable 80 caused by such contact can be prevented.

Further, the slide member 51 is provided with the sloped guide surface 76. The guide surface 76 guides the flexible flat cable 80 so that the flexible flat cable 80 can extend from the slide member 51 in the direction (in the third direction D3) from the photoconductive drum 12 towards the circuit board 78. As illustrated in FIG. 14, a position at which the flexible flat cable 80 extends from the slide member 51 when the slide member 51 is positioned at the distant position is farther than the guide portion 72 of the cable guiding member 71 from the photoconductive drum 12. Accordingly, even when the slide member 51 is switched to the distant position, the flexible flat cable 80 is loosened at a position away from the operation transmission shaft 55 as illustrated in FIG. 14. Therefore, the flexible flat cable 80 can be reliably prevented from making contact with the operation transmission shaft 55.

Next, a description will be made of the cleaning mechanism 64 for cleaning a light irradiating surface (a front surface of the lens array 45) of the LED head 14. That is, when forming an image, as illustrated in FIG. 3, since the LED head 14 is positioned adjacent to the photoconductive drum 12, the remaining toner and paper dust, etc. scattered from the photoconductive drum 12 adhere to and contaminate the LED head 14 negatively affecting exposure. According to the present preferred embodiment of the present invention, in order to overcome the above-described problem, the LED head supporting mechanism 41 is provided with the cleaning mechanism 64 for cleaning the LED head 14.

A description will be made of a configuration of the cleaning mechanism 64. As illustrated in FIG. 11, a cleaning guide rail (a guide member) 66 extends between the LED supporting frames 42 and 43. The cleaning guide rail 66 is arranged above the slide member 51 and in parallel or substantially parallel with a longitudinal direction of the LED head 14.

A sliding body 67 is slidably attached along the cleaning guide rail 66. One end of a rod 68 is connected to the sliding body 67, and the other end of the rod 68 penetrates and extends through the LED supporting frame 42. A cleaning operation lever (a cleaning operation member) 69 is fixed to the penetrating and extending end of the rod 68. Accordingly, by pressing in or drawing out the cleaning operation lever 69, the sliding body 67 can slide in a direction that is parallel or substantially parallel to the longitudinal direction of the LED head 14.

Figure 15:
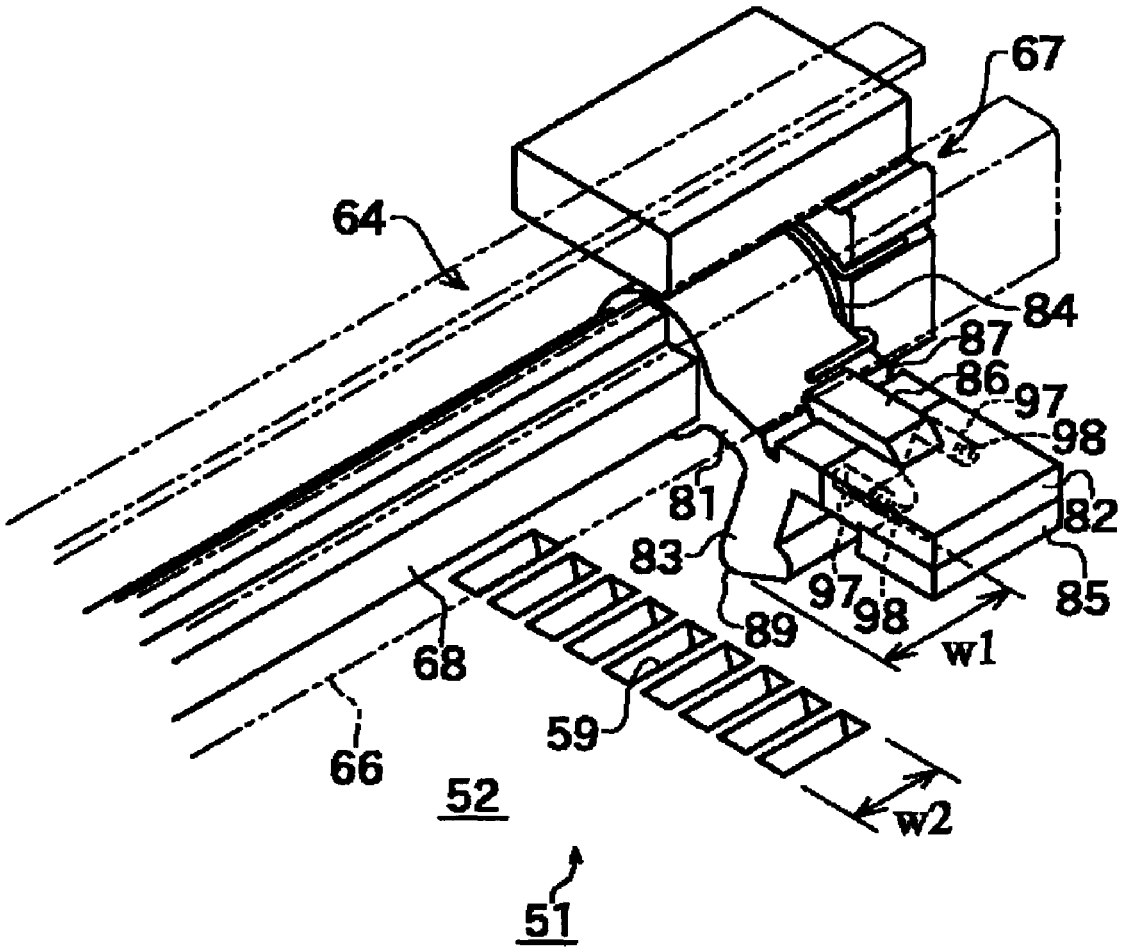
FIG. 15 is an enlarged perspective view of a relevant portion illustrating a configuration of a sliding body, a turning arm, and a brush in detail.

As illustrated in FIG. 15 (an enlarged view of a relevant portion of FIG. 11), a turning arm (a cleaning arm) 81 is axially supported on the sliding body 67. The turning arm 81 can turn around an axis line arranged along a longitudinal direction of the guide rail 44, and can move in parallel or substantially parallel along the axis line with the sliding body 67.

An attaching member 82 is attached to the turning arm 81, and includes a brush (a cleaning body) 85. A contacting arm 83 is arranged at a middle portion of the turning arm 81. A leading end surface (a sliding surface) 89 of the contacting arm 83 makes contact with the upper surface of the base side member 52 of the slide member 51 and can slide thereon. A width w1 of the sliding surface 89 is wider than a width w2 of the rack 59 arranged on the base side member 52.

Further, a biasing spring (a biasing member) 84 is positioned between the sliding body 67 and the turning arm 81. The biasing spring 84 biases the turning arm 81 in a clockwise direction in FIG. 14.

The attaching member 82 includes the brush (the cleaning body) 85, which is preferably made of an acrylic moquette, for example. The brush 85 can clean the front surface of the lens array 45 of the LED head 14. As illustrated in FIG. 15, two attaching pins 97 and 97 are protrudingly arranged at a leading end of the turning arm 81. The attaching member 82 includes attaching holes 98 and 98 such that each of the attaching holes 98 and 98 is arranged concavely to respectively receive the attaching pins 97 and 97. The attaching member 82 further includes a snap fit portion (a latching portion) 86, which can be latched at a groove 87 provided on the turning arm 81. In the above-described configuration, the snap fit portion 86 is latched at the groove 87 by inserting the attaching pin 97 of the turning arm 81 into the attaching hole 98 of the attaching member 82. Thus, the attaching member 82 can be attached to the turning arm 81.

With the above-described configuration, at the adjacent position illustrated in FIGS. 11 through 13 and 15, the base side member 52 of the slide member 51 lifts up the turning arm 81 via the contacting arm 83. In other words, since the leading end surface 89 of the contacting arm 83 makes contact with the slide member 51 against a biasing force of the biasing spring 84, the brush 85 does not make contact with the slide member 51. Thus, since the brush 85 does not make contact with any other components when the slide member 51 is positioned at the adjacent position, the brush 85 does not wear out, and its cleaning effect on the LED head 14 does not decrease.

On the other hand, at the distant position as illustrated in FIG. 14, since the slide member 51 does not lift up the turning arm 81, the turning arm 81 is turned by the biasing force of the biasing spring 84 in a direction in which a leading end of the brush 85 approaches the LED head 14. Accordingly, as illustrated in solid line of FIG. 14, the brush 85 is pressed against the front surface of the lens array 45 of the LED head 14. Under the state as illustrated in FIG. 14, if a user operates to push or draw out the cleaning operation lever 69 illustrated in FIG. 11, the turning arm 81 moves in parallel or substantially parallel along with the sliding body 67. Accordingly, the brush 85 of the attaching member 82 moves along the longitudinal direction of the LED head 14. Thus, the brush 85 can smoothly clean the entire front surface of the lens array 45.

As illustrated in FIG. 11, slant cams (a cam body) 88 and 88 are respectively arranged at each end of a sliding direction of the sliding body 67 (i.e., a sliding direction of the turning arm 81) such that the slant cams 88 and 88 can make contact with the turning arm 81. The slant cams 88 and 88 protrude in a ribbed shape and are arranged on the mutually facing surfaces of the LED supporting frames 42 and 43, which respectively support an end of the cleaning guide rail 66. The slant cams 88 protrude towards a central side of a slide stroke (a parallel or substantially parallel movement stroke of the turning arm 81) of the sliding body 67.

With the above-described configuration, a state will be described in which the brush 85 makes contact with the LED head 14 as illustrated in solid line of FIG. 14, and the brush 85 cleans according to a pushing in/drawing out operation of the cleaning operation lever 69. When the turning arm 81 presently positioned near a center of the parallel or substantially parallel movement stroke moves towards either end portion of the stroke, the turning arm 81 makes contact with a sloped surface of the slant cam 88. Then, the turning arm 81 is pressed by the sloped surface of the slant cam 88, and is turned in a direction against the biasing spring 84 as illustrated in chained line of FIG. 14. Thus, the brush 85 at the leading end of the turning arm 81 moves away from the LED head 14.

Normally, the cleaning operation lever 69 is pressed into one end of an operation stroke thereof (i.e., pressed into an inner side of the main body 513). When cleaning the LED head 14, the pushing in/drawing out operation of the cleaning operation lever 69 is repeated several times, and at last, the cleaning operation lever 69 is pressed into the inner side of the main body 513 again. As described above, under a state in which the cleaning operation lever 69 is pressed in, the turning arm 81 is turned by the slant cam 88 against the biasing spring 84 as illustrated in chained line of FIG. 14. Thus, even when the slide member 51 is positioned at the distant position, normally, the brush 85 is positioned apart from the LED head 14 by the slant cam 88. As a result, the brush 85 is not worn out by being pressed against the LED head 14 for a long time. Moreover, the cleaning effect does not decrease.

In particular, when the brush 85 passes either uneven portion 49 or 49 (illustrated in FIG. 11) arranged at each end of the lens array 45 of the LED head 14, the sloped surface of the slant cam 88 is set at a position where the brush 85 is spaced apart from the LED head 14. Thus, the brush 85 can avoid being detached from the attaching member 82 and being damaged by making contact with the uneven portion 49.

Further, the slant cams 88 and 88 are protrudingly arranged in the ribbed shape at the LED supporting frames 42 and 43, which respectively support each of the ends of the cleaning guide rail 66. The slant cam 88 protrudes towards the central side of the parallel or substantially parallel movement stroke of the turning arm 81 (i.e., towards a central side of a slide stroke of the sliding body 67). Accordingly, the configuration can be simplified and downsized.

Furthermore, since the attaching member 82 is removably attached to the turning arm 81, when foreign materials such as the toner are accumulated in the brush 85, the brush 85 can be easily exchanged along with the attaching member 82. Thus, maintenance can be improved. Moreover, since the attaching member 82 can be removably attached via the snap fit portion 86, attaching screws, etc. are not necessary, and the above described exchanging operation can be easily performed.

In addition, the brush 85 may be directly provided on the turning arm 81 without the attaching member 82. Moreover, in place of the brush 85, fabric may be used to clean the LED head 14.

Although the cleaning operation lever 69 is operated when the slide member 51 is moved to the distant position (FIG. 14), it is possible that the user performs the pushing in/drawing out operation of the cleaning operation lever 69 by mistake at the adjacent position illustrated in FIG. 11. However, according to the present preferred embodiment of the present invention, since the top surface of the rack 59 is flush with the surface of the slide member 51, the turning arm 81 can smoothly move in parallel or substantially parallel along the cleaning guide rail 66, intersecting the rack 59 without damaging the teeth of the rack 59 and the turning arm 81 by catching the end surface (the sliding surface) 89 of the contacting arm 83 on a portion of the rack 59. Moreover, since the cable containing groove 75 of the base side member 52 is closed by the lid cover 77, and the surface of the lid cover 77 is also flush with the surface of the base side member 52, the turning arm 81 can also move in parallel or substantially parallel smoothly intersecting a portion of the cable containing groove 75.

As illustrated in FIG. 15, the width w1 of the sliding surface 89 at the leading end of the contacting arm 83 provided on the turning arm 81 is wider than the width w2 of the rack 59. Accordingly, even if the sliding surface 89 at the leading end of the contacting arm 83 faces a tooth base of the rack 59 when the contacting arm 83 intersects the rack 59 by an erroneous operation of the user as described above, the contacting arm 83 does not get hooked or caught on the tooth base of the rack 59. Therefore, the teeth of the rack 59 and the turning arm 81 can be prevented from being damaged.

As illustrated in FIG. 11, when the turning arm 81 is positioned at the farthest end portion of the parallel or substantially parallel movement stroke, the sliding surface 89 provided on the turning arm 81 does not overlap with the rack 59 at all. Even in such a layout, since the parallel or substantially parallel movement of the turning arm 81 is not restricted by the rack 59, the LED head 14 can be reliably cleaned in its entire longitudinal direction. Particularly, according to the present preferred embodiment of the present invention, when the turning arm 81 is positioned at the farthest end portion of the parallel or substantially parallel movement stoke, since the brush 85 is displaced from a cleaned area (substantially corresponding to an area between the uneven portions 49 and 49) of the LED head 14, the entire area can be reliably cleaned.

The above-described advantages offer greater flexibility to an arranging position of the rack 59. Accordingly, as described in the present preferred embodiment of the present invention, the racks 59 and 59 may be provided as a pair arranged at each end side of the parallel or substantially parallel movement stroke of the turning arm 81, and each of the racks 59 may be arranged at a position closer to the center than the end portion in a longitudinal direction of the cleaned area of the LED head 14. Accordingly, with the above-described layout, the LED head supporting mechanism 41 can be downsized to utilize space more effectively.

Further, according to the present preferred embodiment of the present invention, the turning arm 81 is preferably made of polyacetal resin, i.e., the turning arm 81 is preferably made of a material more slidable (i.e., having less friction) than that of the slide member 51 (the base side member 52 and the leading end side member 53). Accordingly, in a case in which the slide member 51 is switched between the adjacent position and the distant position, or in a case in which the cleaning operation lever 69 is operated by mistake when the slide member 51 is at the adjacent position, the turning arm 81 can smoothly slide with respect to the slide member 51. Moreover, compared to a case in which a surface side of the slide member 51 is made of a material of high slidability, material costs can be reduced.

Furthermore, the turning arm 81 including an axial portion (an axial hole) with respect to the sliding body 67 is integrally and preferably entirely formed of polyacetal resin, for example. Accordingly, the turning arm 81 can smoothly turn, and the sliding surface 89 with respect to the slide member 51 can smoothly slide. At the same time, manufacturing costs can be reduced.

Alternatively, instead of forming the turning arm 81 entirely of polyacetal resin, for example, only the sliding surface 89 may be formed of polyacetal resin. In addition, other plastics or resins having a high slidability, such as polytetrafluoroethylene resin, may be used.

Moreover, the top surface of the rack 59 may be arranged at a position concave from the surface of the base side member 52. In such a case, the contacting arm 83 of the turning arm 81 can also pass over the rack 59 without damaging the teeth of the rack 59. However, as described in the present preferred embodiment of the present invention, when the top surface of the rack 59 is flush with the surface of the base side member 52, it is preferable that the contacting arm 83 can pass over the rack 59 more smoothly.

Figure 16:
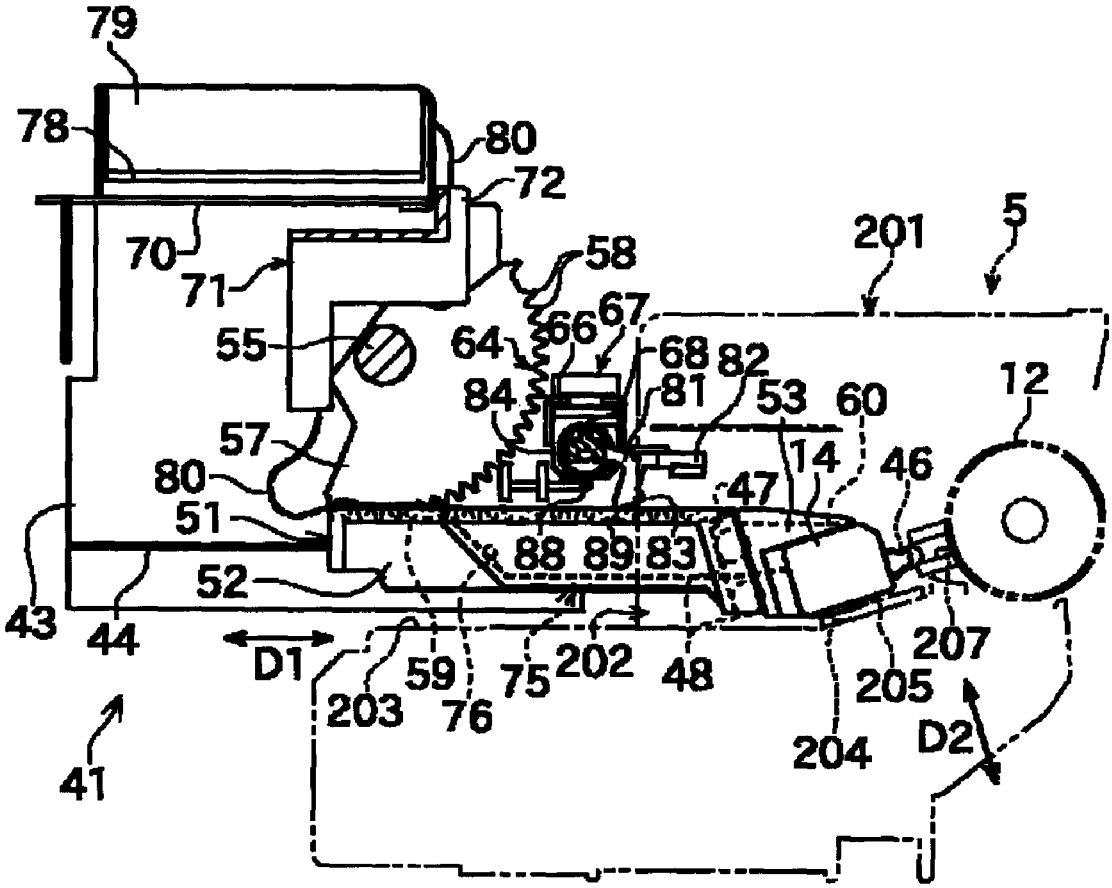
FIG. 16 is a front view of the LED head supporting mechanism under a state in which the slide member is in the adjacent position.

Next, a description will be made of positioning the LED head 14 with respect to the photoconductive drum 12 with reference to FIG. 16. FIG. 16 illustrates a state in which the slide member 51 is being switched from the distant position illustrated in FIG. 14 to the adjacent position illustrated in FIG. 13.

As illustrated in FIG. 16, when the slide member 51 is inserted into the opening 202, the slide member 51 is supported by a side farther from the photoconductive drum 12 (i.e., on a rear side) in a cantilevered state. Accordingly, there is a problem in that the slide member 51 slants and lowers the side of the LED head 14, an angle of the positioning pin 46 also slants, and the positioning pin 46 does not fit into the positioning hole 207.

In order to overcome the above-described problem, according to the present preferred embodiment of the present invention, when the slide member 51 is inserted into the opening 202 and comes close to the adjacent position, a lower surface of a leading end side (the leading end side member 53) of the slide member 51 is guided by an upper surface (a guide surface) of the ribs 205 and 205. As a result, the leading end side member 53 is supported by the ribs 205 and 205, and the positioning pin 46 provided on the LED head 14 can be guided to be smoothly inserted into the positioning hole 207.

According to the present preferred embodiment of the present invention, a sliding direction of the slide member 51 (the first direction D1) is horizontal. On the other hand, the light irradiating direction from the LED head 14 to the photoconductive drum 12 faces obliquely upward, and the direction of the positioning pin 46 also faces obliquely upward. When the sliding direction of the slide member 51 is different from the direction of the positioning pin 46 as described above, the positioning pin 46 may be required to have a tapered shape and the positioning hole 207 may be required to have a tapered shape in which an opening end side of the positioning hole 207 broadens. Otherwise, the positioning pin 46 cannot be inserted into the positioning hole 207. However, in such a state, the positioning cannot be reliably carried out, and oscillation of the LED head 14 may occur.

According to the present preferred embodiment of the present invention, in the slide member 51, the leading end side member 53 moves in the second direction D2 with respect to the base side member 52. The second direction D2 is vertical to the light irradiating direction of the LED head 14 and to the direction of the positioning pin 46. Accordingly, the LED head 14 can be accurately and smoothly positioned with respect to the photoconductive drum 12 without bending the slide member 51 or damaging the positioning hole 207 by the positioning pin 46. Thus, the adjacent position illustrated in FIG. 13 can be achieved.

Since the cylindrical rotating roller 48 is provided between the leading end side member 53 and the base side member 52, the configuration can be simplified, and the leading end side member 53 can smoothly move via rolling movement of the cylindrical rotating roller 48. In addition, since the guide plane 47 on which the cylindrical rotating roller 48 rolls is parallel or substantially parallel to the second direction D2, i.e., parallel or substantially parallel to a moving direction of the leading end side member 53, the configuration can be simplified.

The rib 205 is provided for guiding the leading end side member 53 so that the positioning pin 46 can be smoothly inserted into the positioning hole 207. When the round-shaped portion at the leading end of the positioning pin 46 is inserted into the positioning hole 207, almost simultaneously a lower side of the leading end side member 53 moves slightly away from the rib 205. Thus, the rib 205 does not prevent the positioning by the positioning pin 46.

According to a preferred embodiment of the present invention, an upper surface of the rib 205 guides the leading end side member 53 by making contact with the leading end side member 53 of the slide member 51, however, the rib 205 may guide the LED head 14 by making direct contact with the LED head 14.

Alternatively, a positioning hole forming member may be provided on a side of the LED head 14, and a positioning pin may be provided on a side of the photoconductive drum 12. In such a case, the positioning hole forming member corresponds to a positioning body.

Figure 17:
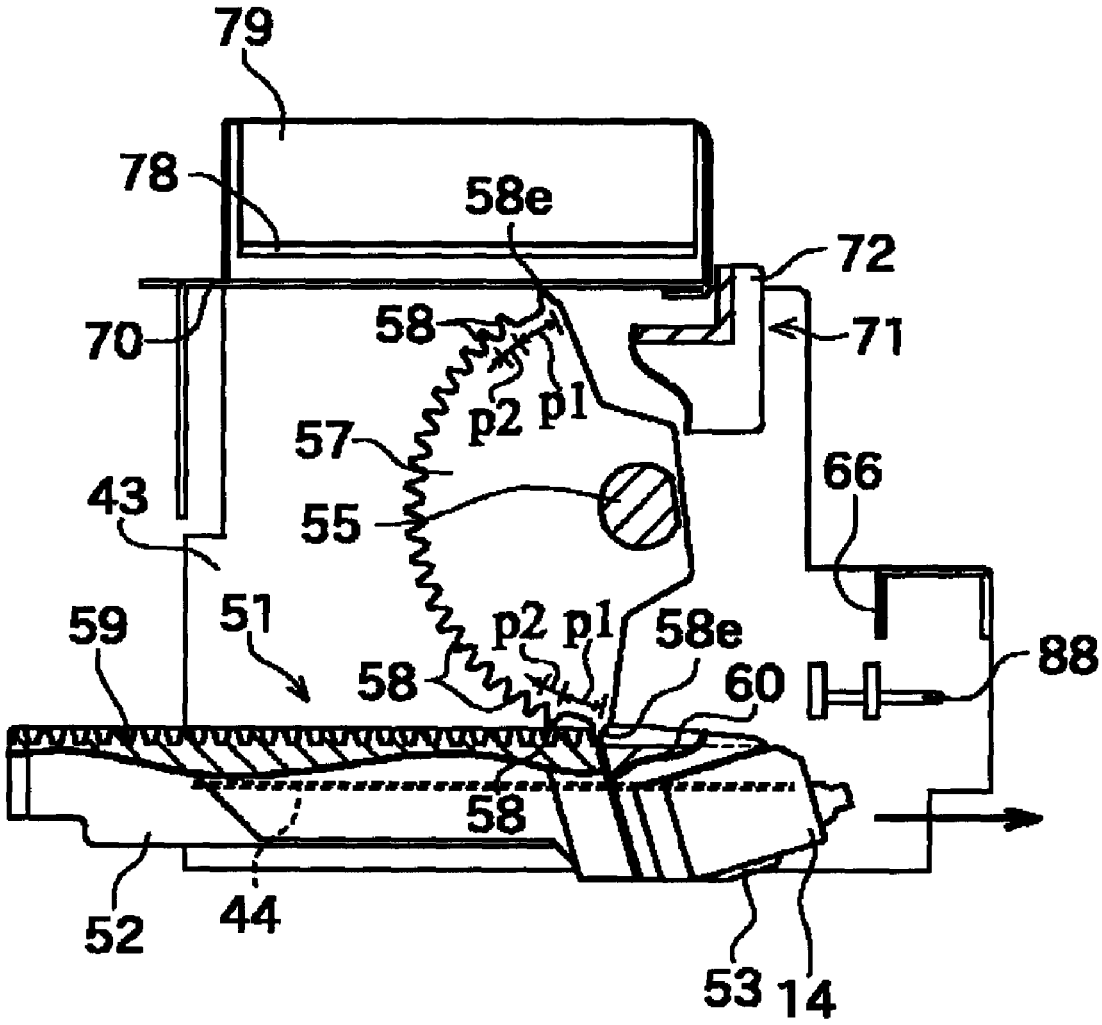
FIG. 17 is a front view illustrating a state in which the slide member is being attached when assembling the LED head supporting mechanism.

Next, a description will be made of the assembly of the LED head supporting mechanism 41 with reference to FIG. 17. As illustrated in FIG. 17, when assembling the LED head supporting mechanism 41, the slide member 51 is inserted between the LED supporting frames 42 and 43 in a direction of a heavy-lined arrow, and a side portion of the base side member 52 fits with the guide rail 44.

Accompanying the above-described inserting operation, the rack 59 engages with the pinion gear 57. Under such a state, the teeth of the rack 59 need to be engaged with the teeth 58 of the pinion gear 57 at the right phase. For example, even if engagement of the rack 59 and the pinion gear 57 is displaced by just one pitch, the LED head 14 at the adjacent position illustrated in FIG. 13 is displaced accordingly, and an electrostatic latent image cannot be normally formed on the photoconductive drum 12.

In order to overcome the above-described problem, in the pinion gear 57 according to the present preferred embodiment of the present invention, a pitch p1 between teeth (an end portion pitch p1) is greater than a pitch p2 between teeth (a normal pitch p2), i.e., p1>p2. The pitch p1 is provided between a tooth 58*e*, which is positioned at the farthest end portion in a circumferential direction of the teeth 58 aligned in the arc, and the tooth 58 that is positioned next to the tooth 58*e*. The pitch p2 is provided between the other teeth 58.

According to the present preferred embodiment of the present invention, the pinion gear 57 is preferably made of a synthetic resin in the above-described shape. Moreover, in the leading end side member 53, which is positioned on a leading end side in an inserting direction of the slide member 51, the concave groove 60 is arranged such that the concave groove 60 extends from the rack 59. A depth of the concave groove 60 is substantially the same as a depth of the base surface of the teeth of the rack 59.

In the above-described configuration, when inserting the slide member 51 between the LED supporting frames 42 and 43, a rotational phase (an angle of the pinion gear 57) of the operation transmission shaft 55 is adjusted so that only the tooth 58*e* at the farthest end portion of the pinion gear 57 is to be positioned inside the concave groove 60, and the other teeth 58 are to be positioned outside the concave groove 60. As described above, in the pinion gear 57, since the pitch p1 between the tooth 58*e*, which is positioned at the farthest end portion of the teeth 58 aligned in the arc, and the next tooth 58, is greater than the pitch p2 between the other teeth 58, only the tooth 58*e* at the farthest end position can be easily positioned inside the concave groove 60.

When inserting the slide member 51 in the above-described state, a tooth at the leading end portion of the rack 59 makes contact with the tooth 58*e* at the farthest end portion of the pinion gear 57 as illustrated in FIG. 17, and the pinion gear 57 starts rotating at this time. In other words, when the tooth 58*e* at the farthest end portion makes contact with the tooth at the leading end portion of the rack 59, a rotational position of the pinion gear 57 is accurately set. Immediately after the pinion gear 57 starts rotating, the tooth 58 next to the tooth 58*e* at the farthest end of the pinion gear 57, and its following teeth 58, sequentially engage with the rack 59. Thus, in the LED head supporting mechanism 41 according to the present preferred embodiment of the present invention, the rack 59 and the pinion gear 57 can be easily engaged at an accurate position when assembling, and are easily manufactured.

Further, the pitch p1 at the end portion is twice as wide as the normal pitch p2 (i.e., p1=2×p2). In other words, after placing the teeth on the pitch equal to the normal pitch p2, the pinion gear 57 has a tooth cutout portion which is formed by cutting away the tooth next to the tooth at the farthest end. Thus, the shape of the pinion gear 57 can be simplified, and the pinion gear 57 can be easily manufactured.

Furthermore, according to the present preferred embodiment of the present invention, not only at one end in the circumferential direction of the pinion gear 57 but also at the other end thereof, the end portion pitch p1 is twice as wide as the normal pitch p2. In other words, a plurality of teeth 58 and the tooth 58*e* of the pinion gear 57 are symmetrically arranged with respect to a center of the arc. Accordingly, even if the pinion gear 57 is reversely placed, a portion on which the end portion pitch p1 greater than the normal pitch p2 is arranged faces the rack 59. Therefore, since a user does not have to consider an attaching direction of the pinion gear 57 when assembling, components can be conveniently handled, and assembly error can be prevented.

The above-described configuration is effective in that when the racks 59 and 59 are preferably provided as a pair, and a plurality of the pinion gears 57 are provided to respectively engage with the racks 59 and 59 as in the present preferred embodiment, identical components can be used as the pinion gear 57, and man-hours in assembling the components can be reduced. Further, according to the present preferred embodiment of the present invention, the racks 59 and 59 have each respective tooth at a similar position with respect to each other, and the pinion gears 57 and 57 are fixed to the operation transmission shaft 55 similarly in phase with respect to each other. Therefore, the pinion gears 57 and 57 can easily and simultaneously engage with the racks 59 and 59.

Alignment of the teeth 58 of the pinion gear 57 may not be symmetrical. The end portion pitch p1 is not limited to be twice as wide as the normal pitch p2, and the end portion pitch p1 is preferably greater than the normal pitch p2 (i.e., p1>p2). However, it is preferable that the end portion pitch p1 is an integral multiple of the normal pitch p2.

Instead of providing two racks 59 and two pinion gears 57 respectively as a pair, more than three or only one rack(s) 59 or pinion gear(s) 57 may be provided. When arranging the leading end side member 53 and the base side member 52 such that the leading end side member 53 does not move with respect to the base side member 52, the rack 59 may extend to the base side member 52.

The configuration according to the present preferred embodiment of the present invention can be applied not only to the copy-and-facsimile MFP 501 but also to a printer, a copying machine, a facsimile machine, or any other suitable machine.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

a light emitting diode head arranged to form an electrostatic latent image by irradiating light onto a photoconductive drum;

a slide member attached to the light emitting diode head, the slide member arranged to move between a position at which the light emitting diode head is adjacent to the photoconductive drum, and a position at which the light emitting diode head is spaced apart from the photoconductive drum; and a positioning body arranged to position the light emitting diode head with respect to the photoconductive drum, the positioning body having an axis that is not parallel to a moving direction of the slide member; wherein the slide member includes a base side member arranged to slide in a first direction and a leading end side member arranged to move with respect to the base side member in a second direction that is different from the first direction; and a rolling body is arranged between the leading end side member and the base side member.

2. The image forming device according to claim 1, wherein the light emitting diode head is provided on the leading end side member, and the positioning body is provided on the light emitting diode head or the leading end side member.

3. The image forming device according to claim 2, wherein the axis of the positioning body is substantially parallel to a light irradiating direction of the light emitting diode head, and the second direction is substantially perpendicular to the axis of the positioning body.

4. The image forming device according to claim 3, wherein the positioning body includes a positioning pin arranged to be inserted into a positioning hole provided in a positioning hole forming member arranged on a side of the photoconductive drum.

5. The image forming device according to claim 4, wherein a positioning portion of the positioning pin includes a portion having a uniform axial cross section.

6. The image forming device according to claim 5, wherein the uniform axial cross section has a substantially cylindrical shape.

7. The image forming device according to claim 1, wherein the rolling body is a cylindrical rotating roller, the cylindrical rotating roller rolls on a guide plane provided on the base side member or on the leading end side member, and the guide plane is substantially parallel to the second direction.

8. An image forming device comprising:

a light emitting diode head arranged to form an electrostatic latent image by irradiating light onto a photoconductive drum;

a slide member attached to the light emitting diode head, the slide member arranged to move between a position at which the light emitting diode head is adjacent to the photoconductive drum, and a position at which the light emitting diode head is positioned apart from the photoconductive drum;

a pair of supporting frames arranged to support the slide member; and a positioning body arranged to position the light emitting diode head with respect to the photoconductive drum, the positioning body having an axis that is not parallel to a moving direction of the slide member; wherein the slide member includes a base side member arranged to slide in a first direction and a leading end side member arranged to move with respect to the base side member in a second direction that is different from the first direction; and a rolling body is arranged between the leading end side member and the base side member.

9. The image forming device according to claim 8, further comprising a guide rail arranged on mutually facing surfaces of the pair of supporting frames.

10. The image forming device according to claim 9, wherein the base side member has a slightly elongated and substantially rectangular shape, and each end portion in a longitudinal direction of the base side member is supported by the pair of supporting frames via the guide rail.

11. The image forming device according to claim 8, wherein the light emitting diode head is provided on the leading end side member, and the positioning body is provided on the light emitting diode head or the leading end side member.

12. The image forming device according to claim 11, wherein the axis of the positioning body is substantially parallel to a light irradiating direction of the light emitting diode head, and the second direction is substantially perpendicular to the axis of the positioning body.

13. The image forming device according to claim 12, wherein the positioning body includes a positioning pin arranged to be inserted into a positioning hole provided in a positioning hole forming member arranged on a side of the photoconductive drum.

14. The image forming device according to claim 13, wherein a positioning portion of the positioning body includes a portion having a uniform axial cross section.

15. The image forming device according to claim 14, wherein the uniform axial cross section has a substantially cylindrical shape.

16. The image forming device according to claim 8, wherein the rolling body is a cylindrical rotating roller, the cylindrical rotating roller rolls on a guide plane provided on the base side member or on the leading end side member, and the guide plane is substantially parallel to the second direction.

* * * * *